US007693465B2

(12) United States Patent
Azami

(10) Patent No.: US 7,693,465 B2
(45) Date of Patent: Apr. 6, 2010

(54) IMAGE FORMING APPARATUS AND PROCESS CARTRIDGE

(75) Inventor: Akira Azami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/248,961

(22) Filed: Oct. 10, 2008

(65) Prior Publication Data

US 2009/0047046 A1 Feb. 19, 2009

Related U.S. Application Data

(62) Division of application No. 11/236,656, filed on Sep. 28, 2005, now Pat. No. 7,457,571.

(30) Foreign Application Priority Data

Sep. 29, 2004 (JP) ..... 2004-283500
Nov. 10, 2004 (JP) ..... 2004-325936

(51) Int. Cl.
*G03G 15/09* (2006.01)

(52) U.S. Cl. ..... 399/267; 399/270; 399/277

(58) Field of Classification Search ..... 399/270, 399/267, 277
See application file for complete search history.

(56) References Cited

U.S. PATENT DOCUMENTS 5,321,473 A 6/1994 Azami
5,336,580 A * 8/1994 Tavernier et al.
5,428,428 A * 6/1995 Haneda
5,554,479 A * 9/1996 Ochiai et al. ..... 399/270
5,876,893 A * 3/1999 Ochiai et al.
6,674,985 B2 1/2004 Azami
6,757,509 B2 6/2004 Shoji et al.
6,895,203 B2 5/2005 Ozeki et al.
6,904,244 B2 6/2005 Azami et al.
7,162,187 B2 1/2007 Koichi et al.
2004/0009421 A1 1/2004 Mizuish
2005/0053400 A1 3/2005 Ozeki et al.
2005/0058464 A1 3/2005 Azami et al.

FOREIGN PATENT DOCUMENTS

JP 63-208867 8/1988
JP 9-43910 2/1997
JP 10-20611 1/1998
JP 2735096 1/1998
JP 11-184139 7/1999
JP 2000-89507 3/2000
JP 2001-281994 10/2001

(Continued)

*Primary Examiner*—David M Gray
*Assistant Examiner*—Laura K Roth
(74) *Attorney, Agent, or Firm*—Oblon, Spivak, McClelland, Maier & Neustadt, L.L.P.

(57) ABSTRACT

An image forming apparatus and process cartridge which uses a two-component developer comprising a toner and a carrier. By using toner and carrier having a small-particle size, deterioration of the toner fluidity over time can be avoided, and further by maintaining stable toner charge even in a low-humidity environment, stable high-quality image formation can be achieved. The occurrence of adherence of carrier to the solid portions of the toner image is reduced in addition to the occurrence of adherence of carrier to the edge portions, and image abnormalities, toner scattering and the like are prevented.

6 Claims, 19 Drawing Sheets

| | | ADHERENCE OF CARRIER TO THE SOLID PORTIONS | ADHERENCE OF CARRIER TO THE EDGE PORTIONS | GRANULARITY | BLANKING OUT AT TRAILING EDGE | HALO IMAGE | SURFACE SOILING | TONER SCATTERING |
|---|---|---|---|---|---|---|---|---|
| DEVELOPING GAP (mm) | < 0.2 | X | O | O | O | X | O | O |
| | 0.2~0.5 | O | O | O | O | O | O | O |
| | > 0.5 | O | O | O | X | O | X | X |
| LINEAR SPEED RATIO | < 1.2 | X | O | X | X | O | O | O |
| | 1.2~2.5 | O | O | O | O | O | O | O |
| | > 2.5 | X | X | O | X | X | O | X |
| MAGNET FORCE OF MAIN POLE (mT) | < 80 | X | X | O | O | O | O | O |
| | 80~160 | O | O | O | O | O | X | O |
| | > 160 | O | O | O | O | O | X | O |
| ANGLE OF MAIN POLE (°) | < 0 | X | X | X | O | O | X | X |
| | 0~10 | O | O | O | O | O | O | O |
| | > 10 | X | X | X | O | O | O | O |
| MAGNETIC FORCE OF MAGNETIC POLE P2 (mT) | < 80 | X | X | X | O | O | O | O |
| | 80~140 | O | O | O | O | O | O | O |
| | > 140 | O | O | O | O | O | O | O |
| TONER CONCENTRATION (WT%) | < 4 | X | O | X | O | O | O | O |
| | 4~14 | O | O | O | O | O | X | O |
| | > 14 | O | O | X | O | O | X | O |
| DRUM AMOUNT OF DEVELOPER (mg/cm²) | < 40 | O | O | X | O | O | X | X |
| | 40~70 | O | O | O | O | O | O | O |
| | > 70 | X | O | O | O | X | O | O |
| DEVELOPING POTENTIAL (V) | < 300 | O | O | O | O | O | O | O |
| | 300~700 | O | O | O | O | O | O | O |
| | > 700 | X | O | O | O | O | O | O |
| SURFACE POTENTIAL (V) | < 50 | O | O | O | O | O | X | O |
| | 50~250 | O | O | O | O | O | O | O |
| | > 250 | O | X | O | O | X | O | O |
| CTL FILM THICKNESS (μm) | < 20 | X | O | O | X | O | O | O |
| | 20~40 | O | O | O | O | O | O | O |
| | > 40 | O | X | O | O | X | O | O |
| TONER PARTICLE SIZE (μm) | < 3.5 | O | O | O | O | O | O | O |
| | 3.5~7.5 | O | O | O | O | O | O | O |
| | > 7.5 | O | O | X | O | O | O | O |
| CARRIER PARTICLE SIZE (μm) | < 20 | X | X | O | O | O | O | O |
| | 20~60 | O | O | O | O | O | O | O |
| | > 60 | O | O | X | O | O | O | O |
| CARRIER RESISTANCE (Ω·cm) | < 10⁸ | X | O | O | O | O | O | O |
| | 10⁸~10¹⁴ | O | O | O | O | O | O | O |
| | > 10¹⁴ | O | X | X | O | X | O | O |
| CARRIER SATURATION MAGNETIZATION (emu/g) | < 40 | X | O | O | O | O | O | O |
| | 40~80 | O | O | O | O | O | O | O |
| | > 80 | O | O | O | O | O | O | O |

FOREIGN PATENT DOCUMENTS

| | | |
|---|---|---|
| JP | 2002-72690 | 3/2002 |
| JP | 2002-91138 | 3/2002 |
| JP | 2002-207321 | 7/2002 |
| JP | 2002-268388 | 9/2002 |
| JP | 2002-278164 | 9/2002 |
| JP | 2002-328484 | 11/2002 |
| JP | 2003-76121 | 3/2003 |
| JP | 2003-167374 | 6/2003 |
| JP | 2003-202757 | 7/2003 |
| JP | 2003-223052 | 8/2003 |
| JP | 2004-21122 | 1/2004 |
| JP | 2004-125939 | 4/2004 |
| JP | 2004-184452 | 7/2004 |
| JP | 2004-191881 | 7/2004 |
| JP | 2004-212560 | 7/2004 |
| JP | 2004-251923 | 9/2004 |

* cited by examiner

FIG. 2

EVALUATION STANDARDS FOR GRANULARITY RANKINGS

| RANK | VIEWED WITH MAGNIFYING GLASS | VIEWED WITH NAKED EYE |
|---|---|---|
| 5 | ALL DOT SHAPES UNIFORM. NO DOTS MISSING AND NO DUST. | SMOOTH APPEARANCE |
| 4 | DOT SHAPES VIRTUALLY UNIFORM. SMALL NUMBER OF DOTS MISSING / DUST HARKS. | SMOOTH APPEARANCE |
| 3 | DOT SHAPES FAIRLY UNIFORM | SLIGHT BLURRING |
| 2 | DOTS ARRANGED IRREGULARLY. VARIATION IN DOT SIZES. | BLURRED |
| 1 | SOME DOTS MISSING. | VERY BLURRED |

FIG. 3

DEVELOPING GAP (Gp) AND GRANULARITY RANKS

| Gp (mm) | 8.0 μm TONER | 7.0 μm TONER | 6.0 μm TONER |
|---|---|---|---|
| 0.2 | 5.0 | 5.0 | 5.0 |
| 0.3 | 5.0 | 5.0 | 5.0 |
| 0.4 | 4.0 | 5.0 | 5.0 |
| 0.5 | 3.0 | 4.0 | 5.0 |
| 0.6 | 2.5 | 3.5 | 4.5 |

FIG. 10

EMBEDDING RANKS

| RANK | STATE ON TONER SURFACE |
|---|---|
| 4 | HALF APPEARS ON SURFACE |
| 3 | APPROX. 1/3 APPEARS ON SURFACE |
| 2 | SMALL AMOUNT APPEARS IN INDENTATIONS |
| 1 | NONE ON SURFACE |

FIG. 11

SILICA PARTICLE SIZE AND EMBEDDING

| SILICA PARTICLE SIZE (nm) | EMBEDDING RANK OF SILICA |
|---|---|
| 50 | 3 |
| 100 | 4 |
| 120 | 4 |

FIG. 12

ADDED AMOUNT OF LARGE-PARTICLE SILICA AND OCCURRENCE OF FILMING

| ADDED AMOUNT OF LARGE- PARTICLE SILICA (WT%) | PRESENCE / ABSENCE OF FILMING |
|---|---|
| 0.2 | DOES NOT OCCUR |
| 0.5 | DOES NOT OCCUR |
| 0.7 | DOES NOT OCCUR |
| 1.0 | OCCURS |

EMBEDDING OF SMALL-PARTICLE SILICA WHEN 0.5WT% OF 120nm LARGE PARTICLE SILICA IS ADDED

| PARTICLE SIZE OF SMALL- PARTICLE SILICA (nm) | EMBEDDING RANK OF SMALL-PARTICLE SILICA |
|---|---|
| 20 | 3 |
| 30 | 2 |
| 50 | 2 |

ADDED AMOUNT OF SMALL-PARTICLE SILICA AND OCCURRENCE OF FILMING

| ADDED AMOUNT OF SMALL-PARTICLE SILICA (WT%) | PRESENCE / ABSENCE OF FILMING |
|---|---|
| 1.0 | DOES NOT OCCUR |
| 1.5 | DOES NOT OCCUR |
| 2.0 | DOES NOT OCCUR |
| 2.5 | OCCURS |

SURFACE SOILING WHEN PASSING 500 SHEETS CONTINUOUSLY, WITH LOW IMAGE AREA (0.5%, A4)

| TONER PARTICLE SIZE (μm) | ΔID WHEN LARGE-PARTICLE SILICA NOT ADDED | ΔID WHEN 0.5WT% OF LARGE-PARTICLE SILICA ADDED |
|---|---|---|
| 4.5 | 0.020～0.027 | 0.012～0.020 |
| 5.5 | 0.001～0.011 | 0.001～0.005 |
| 7.0 | 0.001 | 0.001 |

FIG. 20

| | TONER PARTICLE SIZE (μm) | CARRIER PARTICLE SIZE (μm) | ADDED AMOUNT OF LARGE-PARTICLE SILICA (WT%) | ADDED AMOUNT OF SMALL-PARTICLE SILICA (WT%) | ADDED AMOUNT OF TITANIUM OXIDE (WT%) | PROBLEMS (ESPECIALLY, SURFACE SOILING) |
|---|---|---|---|---|---|---|
| EXAMPLE 1 | 5.5 | 20 | 0.20 | 1.0 | 0.7 | NONE |
| COMP. EX. 1 | 5.0 | 20 | 0.20 | 1.0 | 0.7 | POOR CLEANING |
| COMP. EX. 2 | 5.5 | 15 | 0.20 | 1.0 | 0.7 | ADHERENCE OF CARRIER |
| COMP. EX. 3 | 5.5 | 20 | 0.15 | 1.0 | 0.7 | SURFACE SOILING |
| COMP. EX. 4 | 5.5 | 20 | 0.20 | 0.8 | 0.7 | SURFACE SOILING |
| COMP. EX. 5 | 5.5 | 20 | 0.20 | 1.0 | 0.6 | SURFACE SOILING |

FIG. 24

| | | ADHERENCE OF CARRIER TO THE SOLID PORTIONS | ADHERENCE OF CARRIER TO THE EDGE PORTIONS | GRANULARITY | BLANKING OUT AT TRAILING EDGE | HALO IMAGE | SURFACE SOILING | TONER SCATTERING |
|---|---|---|---|---|---|---|---|---|
| DEVELOPING GAP (mm) | < 0.2 | × | ○ | ○ | × | ○ | ○ | ○ |
| | 0.2–0.5 | ○ | ○ | ○ | ○ | ○ | ○ | ○ |
| | > 0.5 | ○ | ○ | × | ○ | × | △ | × |
| LINEAR SPEED RATIO | < 1.2 | ○ | ○ | × | ○ | ○ | × | ○ |
| | 1.2–2.5 | ○ | ○ | ○ | ○ | ○ | ○ | ○ |
| | > 2.5 | × | × | ○ | × | × | ○ | × |
| MAGNET FORCE OF MAIN POLE (mT) | < 80 | × | × | ○ | ○ | ○ | ○ | ○ |
| | 80–140 | ○ | ○ | ○ | ○ | ○ | ○ | ○ |
| | > 140 | ○ | ○ | ○ | ○ | ○ | ○ | ○ |
| ANGLE OF MAIN POLE (° ) | < 0 | △ | △ | ○ | ○ | ○ | △ | ○ |
| | 0–10 | ○ | ○ | ○ | ○ | ○ | ○ | ○ |
| | > 10 | ○ | ○ | △ | ○ | ○ | ○ | ○ |
| MAGNETIC FORCE OF MAGNETIC POLE P2 (mT) | < 60 | × | × | ○ | ○ | ○ | ○ | ○ |
| | 60–140 | ○ | ○ | ○ | ○ | ○ | ○ | ○ |
| | > 140 | ○ | ○ | ○ | ○ | ○ | ○ | ○ |
| TONER CONCENTRATION (WT%) | < 4 | × | ○ | × | ○ | ○ | ○ | ○ |
| | 4–14 | ○ | ○ | ○ | ○ | ○ | ○ | ○ |
| | > 14 | ○ | ○ | ○ | ○ | ○ | × | × |
| DRUM AMOUNT OF DEVELOPER (mg/cm$^2$) | < 40 | ○ | ○ | × | ○ | ○ | × | × |
| | 40–70 | ○ | ○ | ○ | ○ | ○ | ○ | ○ |
| | > 70 | △ | ○ | ○ | ○ | △ | ○ | ○ |
| DEVELOPING POTENTIAL (V) | < 300 | ○ | ○ | ○ | ○ | ○ | ○ | ○ |
| | 300–700 | ○ | ○ | ○ | ○ | ○ | ○ | ○ |
| | > 700 | △ | ○ | ○ | ○ | ○ | ○ | ○ |
| SURFACE POTENTIAL (V) | < 50 | ○ | ○ | ○ | ○ | ○ | △ | ○ |
| | 50–250 | ○ | ○ | ○ | ○ | ○ | ○ | ○ |
| | > 250 | ○ | × | ○ | △ | △ | ○ | ○ |
| CTL FILM THICKNESS (μm) | < 20 | × | ○ | ○ | × | ○ | ○ | ○ |
| | 20–40 | ○ | ○ | ○ | ○ | ○ | ○ | ○ |
| | > 40 | ○ | × | ○ | ○ | × | ○ | ○ |
| TONER PARTICLE SIZE (μm) | < 3.5 | ○ | ○ | ○ | ○ | ○ | ○ | ○ |
| | 3.5–7.5 | ○ | ○ | ○ | ○ | ○ | ○ | ○ |
| | > 7.5 | ○ | ○ | × | ○ | ○ | ○ | ○ |
| CARRIER PARTICLE SIZE (μm) | < 20 | × | × | ○ | ○ | ○ | ○ | ○ |
| | 20–60 | ○ | ○ | ○ | ○ | ○ | ○ | ○ |
| | > 60 | ○ | ○ | × | ○ | ○ | ○ | ○ |
| CARRIER RESISTANCE (Ω cm) | < $10^{10}$ | × | ○ | ○ | × | ○ | ○ | ○ |
| | $10^{10}$–$10^{16}$ | ○ | ○ | ○ | ○ | ○ | ○ | ○ |
| | > $10^{16}$ | ○ | × | × | ○ | × | ○ | ○ |
| CARRIER SATURATION MAGNETIZATION (emu/g) | < 40 | × | × | ○ | ○ | ○ | ○ | ○ |
| | 40–90 | ○ | ○ | ○ | ○ | ○ | ○ | ○ |
| | > 90 | ○ | ○ | ○ | ○ | ○ | ○ | ○ |

IMAGE FORMING APPARATUS AND PROCESS CARTRIDGE

CROSS-REFERENCE TO RELATED APPLICATIONS

This application is a divisional of and claims the benefit of U.S. application Ser. No. 11/236,656, filed Sep. 28, 2005 now U.S. Pat. No. 7,457,571, the entire content of this applications is incorporated herein by reference. U.S. application Ser. No. 11/236,656 claims priority to Japanese Patent Application Nos. 2004-325936, filed Nov. 10, 2004 and 2004-283500, filed Sep. 29, 2004.

BACKGROUND OF THE INVENTION

1. Field of the Invention

The present invention relates to an image forming apparatus using an electrophotographic system, such as a copying machine, printer, facsimile device, or a composite device of these, and to a process cartridge installed in same, and more particularly, to an image forming apparatus and process cartridge which use a two-component developer comprising a toner and carrier.

2. Description of the Background Art

Conventionally, in an electrophotographic image forming apparatus, or the like, a magnetic brush developing system using a two-component developer comprising a magnetic carrier and a toner is adopted in order to develop an electrostatic latent image formed on a latent image carrier. Normally, a developing device based on this system comprises an internally provided magnetic roller made of a magnetic body having a plurality of magnetic poles, a frame which accommodates the magnetic roller, and a developing sleeve which is a cylindrical developer carrier that is supported in a rotatable fashion. Magnetic carrier to which toner is attached is held by the magnetic force of the magnetic roller on the surface of the developing sleeve, and it is conveyed to a developing region where developing is carried out. Furthermore, in order to improve the fluid characteristics of the toner, fine non-organic particles of small particle size, such as silica, are added to the toner as an external additive.

Due to recent demands for improved image quality in image forming apparatuses, there has been a tendency to reduce the particle size of the toner and the magnetic carrier, and reduce the interval between the photosensitive body forming the image carrier and the developing roller forming the developer carrier (hereafter, this interval is called the "developing gap"). However, as the particle sizes of the toner and the carrier become smaller, so the surface area of the particles becomes greater with respect to the mass of the toner and carrier. Consequently, contact becomes more liable to occur between respective toner particles, or between toner particles and carrier particles, and the resulting friction is liable to degrade the fluidity. Furthermore, since the indentations in the surface of the toner also become smaller, then a phenomenon occurs whereby the toner additive, such as silica, which serves to improve the fluidity of the toner, becomes embedded in the surface of the toner, and hence deterioration of the fluidity over time becomes more liable to occur. This deterioration of the fluidity impedes the dispersion of the toner within the developer, and hence insufficiently charged toner or inversely charged toner arises, which ultimately leads to soiling of the bare surface regions of the image. Furthermore, in a state of degraded fluidity, aggregation of toner also occurs, and soiling due to large particles on the bare surface regions also present a serious image defect.

In principle, the toner additive having a small particle size enters in between respective toner particles and between toner particles and magnetic carrier particles, and prevents the microparticles of toner and magnetic carrier from adhering tightly to each other, thereby preventing increase in intermolecular forces, reducing the adhesive force, and hence serving to increase fluidity. By improving fluidity, the occurrence of aggregated toner particles, or undercharged toner or inversely charged toner due to impeded dispersion of the toner, is reduced, and hence it is possible to reduce the occurrence of soiling caused by same, and the like. However, if the phenomenon of embedding of the additive occurs, then this promotes adhesion between toner particles and between toner and magnetic carrier particles, and hence the aforementioned fluidity declines. If the fluidity declines, then aggregation of toner and soiling of the bare image surface is liable to occur.

Embedding of the additive is a phenomenon which occurs during the churning action inside the developing device. Therefore, the greater the number of images formed, the longer the churning time and the greater the amount of additive that becomes embedded.

It is known that an effective method of reducing the amount of additive which becomes embedded when using toner of small particle size of this kind involves adding both silica forming an additive which serves to improve fluidity (hereinafter, called "small-particle silica") and large-particle silica having a larger particle size than the small-particle silica (hereinafter, called "large-particle silica"), as disclosed in Japanese Patent Laid-open No. 2000-81723, for example.

In general, silica added in order to improve fluidity has high hardness compared to the toner particles, and its particle size is sufficiently small compared to the particle size of the toner particles and carrier particles and the surface area of the contact surfaces between the silica and the toner particles is also small. If the surface area of the contact surface is small, then when force is applied, the pressure will not be dispersed readily and hence the silica is liable to become embedded into the toner particles, which are softer than the silica. Consequently, if only small-particle silica is added, then when a toner particle collides with a carrier particle and the force of this impact is applied to the silica, then the small-particle silica situated between the toner particle and the carrier particle will readily become embedded in the toner particle. Embedding of this kind occurs not only between a toner particle and a carrier particle, but also between respective toner particles.

On the other hand, if both large-particle silica and small-particle silica are used conjointly, then since the large-particle silica has a larger particle size than the small-particle silica, the surface area of the contact surface with the toner is increased. If the surface area of the contact surface is large, then even if a toner particle and carrier particle collide and a force of similar magnitude to that received by the small-particle silica described above is applied to the silica, the resulting pressure is dispersed and hence the silica is not liable to become embedded. As a result, the large-particle silica serves as a spacer. Since the large-particle silica serves as a spacer, it is possible to suppress the silica embedding action caused by small-particle silica located between a toner particle and a carrier particle, or between two toner particles.

However, if the added amount of large-particle silica is too large with respect to the toner, then not all of the large-particle silica will adhere to the surface of the toner particles, and the surplus silica will cause filming on the surface of the photosensitive body. On the other hand, if the added amount of large-particle silica is too small, then it will not serve adequately as a spacer and it will not be possible to prevent embedding of the small-particle silica, thus leading to deterioration of toner fluidity. Moreover, if the added amount of small-particle silica is too large, then the surplus silica will cause filming on the photosensitive is body and if the added amount of small-particle silica is too small, then this will lead to deterioration of toner fluidity.

Due to these reasons, determining the amount of additive added with respect to the toner is important in forming desirable images. In Japanese Patent Laid-open No. 2000-81723, added amounts which enable desirable images to be formed are stipulated in respect of both the large-particle silica and the small-particle silica. However, the image forming apparatus described in Japanese Patent Laid-open No. 2000-81723 uses a non-magnetic one-component developer only, and does not investigate a two-component developer which uses a toner and a carrier.

Furthermore, if the particle size of the toner is reduced, then the surface area increases with respect to the weight of the toner, and therefore, if the charge density on the surface is uniform, the amount of charge per unit mass (Q/M) increases. If the charge rises excessively, then the electrostatic charge of the magnetic carrier is spent by the toner particles in the high-charge region of the charge distribution, and uncharged toner, which has been supplied more recently, does not receive a sufficient charge, leading in turn to toner scattering, soiling, and other problems. This issue is particularly notable in low-humidity environments where frictional charging occurs more readily.

On the other hand, Japanese Patent Laid-open No. 2004-212560 describes an image forming apparatus, such as a color copying device, color printer, or the like, using a two-component developer comprising a toner and a carrier, as described above, in which a developing step is performed by applying only a DC developing bias to a developing sleeve which holds the two-component developer.

A developing method using a two-component developer is considered to produce better and more stable quality in the output image than a developing method using a one-component developer, because the charging of the toner is stabilized. Furthermore, a developing method which applies only a DC developing bias to a developing sleeve allows the composition and control procedure of the power supply unit to be simplified, and hence reduces device costs, in comparison with a developing method which applies both a DC and an AC developing bias, or a developing method which applies only an AC developing bias. What is more, it is less liable to give rise to blurred images as a result of carrier particles having low resistance.

Japanese Patent Laid-open No. 2004-212560 described above discloses technology for an image forming apparatus which adopts a developing method that uses a two-component developer and applies only a DC developing bias, and which uses a carrier of small size as the carrier in the two-component developer, in order to achieve high image quality. Consequently, the occurrence of adhesion of carrier particles is reduced, and the occurrence of blurred images or loss of peripheral areas of text is also reduced. More specifically, by optimizing the static resistance and saturation magnetization of the carrier when using a small-particle carrier having a weight-average size of 20 to 60 μm, the aforementioned problems are diminished.

Furthermore, the technology in Japanese Patent Laid-open No. 2004-212560 described above is able to reduce the occurrence of blurred images and the loss of peripheral regions of text, as well as reducing adherence of the carrier to edge portions of the toner image formed on the image carrier, such as the photosensitive drum, but there are cases where it is not able to suppress adherence of carrier to solid portions of the toner image, adequately. In particular, if the photosensitive drum and the developing device (developing sleeve, and the like) are reduced in size as the image forming apparatus is compactified, then adherence of carrier to the solid portions becomes much more liable to appear.

A more detailed description of the adherence of carrier particles to the edge portions and the solid portions is given below.

In other words, as described above, adherence of the carrier to the photosensitive drum includes adherence of the carrier to the edge portions of the toner image on the photosensitive drum (hereinafter, called "adherence of carrier to edge portions") and adherence of the carrier to the solid portions of the toner image on the photosensitive drum (hereinafter, called "adherence of carrier to solid portions").

Adherence of carrier to the edge portions is a phenomenon in which carrier adheres to the edge portions of the toner image on the photosensitive drum (in other words, the boundary between the image section and the non-image section) due to the counter-charge of the carrier. In the image section (toner image) on the photosensitive drum, an electric field is formed in a direction which moves the toner from the developing sleeve and onto the photosensitive drum. On the other hand, in the non-image section (bare surface section) on the photosensitive drum, an electric field is formed in the opposite direction to the direction of movement of the toner from the developing sleeve onto the photosensitive drum. Therefore, at the edge portions, an electric field (called an "edge electric field") is formed, in which the electric field acting in the aforementioned opposite direction is accentuated. In a region where an "edge electric field" of this kind is acting, the carrier moves onto the photosensitive drum and adheres to the drum, due to the counter-charge which remains on the surface of the carrier after movement of the toner. This adherence of carrier to the edge portions is a phenomenon which becomes more notable, the greater the resistance of the carrier.

On the other hand, adherence of carrier to the solid portions is a phenomenon in which carrier adheres to the solid portions of the toner image on the photosensitive drum (the solid image portions), due to electrical charge induced electrostatically in the carrier. The adherence of carrier to the solid portions is particularly liable to occur in cases where the developing potential of the solid portion (in other words, the electric field potential formed in the image section) is high, or where the surface potential (in other words, the electric field potential in the opposite direction, which is formed in the non-image section) is high, or the resistance of the carrier is low.

In this respect, it has been considered that adherence of carrier to the solid portions can be reduced by adjusting the developing potential and the surface potential. However, any adjustment of the developing potential and the surface potential has a direct affect on image quality characteristics, such as image density, surface soiling, and the like, and therefore, such adjustment is subject to limitations. Furthermore, it has also been considered that adherence of carrier to the solid portions can be reduced by setting the carrier resistance to a high value. However, setting a high carrier resistance runs counter to measures for reducing adherence of carrier to the edge portions described above. In other words, if the carrier resistance is set to a high value, then although this reduces adherence of carrier to the solid portions, the adherence of carrier to the edge portions becomes more pronounced.

On the other hand, as described above, recently there have been strong demands for reduced size and higher image quality in image forming apparatuses, and in order to reduce the size of an image forming apparatus, it is necessary to reduce the size of the photosensitive drum, developing sleeve, and the like. However, if the external diameter of the photosensitive drum and developing sleeve is reduced, then on the downstream side in the direction of rotation from the position at which the drum and sleeve oppose each other (in other words, the developing region), there will be a reduction in the magnetic constriction force acting on the carrier at the tip of the magnetic brush created by the two-component developer held on a developing sleeve. Therefore, in addition to adherence of carrier to the edge portions, adherence of carrier to the solid portions also becomes more liable to occur.

In response to this, it has been considered that reduction of the magnetic constriction force acting on the carrier can be offset by setting the saturation magnetization of the carrier to a high value. However, since there is a certain degree of correlation between the saturation magnetization of the carrier and its resistance (namely, the fact that the resistance tends to decrease as the saturation magnetization becomes higher), then there are also limitations on the adjustment of the saturation magnetization.

Furthermore, in order to achieve high image quality, as described above, it is necessary to reduce the particle size of the toner while also reducing the particle size of the carrier. However, if the size of the carrier particles is reduced, then the magnetic force acting on each carrier particle becomes smaller, and therefore, adherence of carrier to the solid portions becomes more liable to occur in addition to adherence of carrier to the edge portions. Japanese Patent Laid-open No. 2004-212560 described above, and other references, specify conditions for the small-diameter carrier (in other words, static resistance, saturation magnetization, and the like), in order to reduce the occurrence of secondary effects, such as image blurring and loss of the peripheral region of text, and so on. However, adequate settings are not provided in respect of small-diameter carrier conditions for reducing the occurrence of adherence of carrier to the solid portions.

If adherence of carrier to the solid portions and adherence of carrier to the edge portions occurs, the members such as the cleaning blade and the intermediate transfer belt, which make contact with the photosensitive drum, become soiled by the adhering carrier particles, and these adhering carrier particles are transferred onto the transfer receiving medium, leading to blanking out of the image.

SUMMARY OF THE INVENTION

A first object of the present invention is to provide an image forming apparatus and a process cartridge which prevents deterioration over time of the fluidity of the toner, while achieving high image quality by using toner and carrier of small particle size, and furthermore, which is able to achieve stable formation of images of high quality, by maintaining stable toner charge, even in a low-humidity environment.

A second object of the present invention is to provide an image forming apparatus and process cartridge which satisfies both the objects of reducing the size of the apparatus and achieving high image quality, while also reducing the occurrence of adherence of carrier to the solid portions in addition to adherence of carrier to the edge portions, and reducing the occurrence of secondary effects, such as image abnormalities, toner scattering, and the like.

An image forming apparatus of the present invention comprises an image carrier which holds an electrostatic latent image on the surface thereof; a developer carrier, having an internally fixed magnetic field generating device which rotates while holding a two-component developer comprising a magnetic carrier and a toner on the surface thereof to oppose the image carrier; and a developing electric field generating device which generates a developing electric field between the image carrier and the developer carrier. The electrostatic latent image on the image carrier is converted into a toner image by the action of the developing electric field, using the toner of the two-component developer held on the developer carrier. The volume-average particle size of the toner is 5.5 through 8.0 (μm). The volume-average particle size of the magnetic carrier is 20 through 40 (μm). The gap between the image carrier and the developer carrier is 0.3 through 0.6 (mm) and the tolerance is within ±0.125 (mm). 0.2 through 0.7 (wt %) of hydrophobic silica having a particle size of 100 (nm) or above, 1.0 through 2.0 (wt %) of hydrophobic silica having a particle size of 20 (nm) or below, and 0.7 through 1.0 (wt %) of titanium oxide are added to the toner.

An image forming apparatus of the present invention comprises a photosensitive drum, having a CTL layer, on which a desired electrostatic latent image is formed; and a developing unit which accommodates a two-component developer comprising a toner and a carrier, provided with a developing sleeve which holds the two-component developer in a position opposing the photosensitive drum. The external diameter of the photosensitive drum is 20 through 70 mm, and the film thickness of the CTL layer is 20 through 40 μm. The external diameter of the developing sleeve is 10 through 30 mm. A DC developing bias only is applied to the developing sleeve. The drawn amount of the two-component developer which is drawn onto the developing sleeve and arrives at the opposing position is 40 through 70 mg/cm$^2$. The magnetic flux density in the normal direction of a main pole formed at the opposing position, of a plurality of magnetic poles formed on the developing sleeve, is 80 through 140 mT, and the magnetic flux density in the normal direction of a magnetic pole P2 formed adjacent to the main pole on the downstream side is 60 through 140 mT. The gap between the photosensitive drum and the developing sleeve at the opposing position is 0.2 through 0.5 mm. The linear speed ratio of the developing sleeve with respect to the photosensitive drum at the opposing position is 1.2 through 2.5. The toner concentration of the two-component developer accommodated in the developing unit is controlled so as to be 4 through 14 wt %. The weight-average particle size of the toner is 3.5 through 7.5 μm. The carrier has a weight-average particle size of 20 through 60 μm, a static resistance of $10^{10}$ through $10^{16}$ Ω·cm, and a saturation magnetization of 40 through 90 emu/g.

A process cartridge installed detachably in the main body of an image forming apparatus in accordance with the present invention comprises an image carrier which holds an electrostatic latent image on the surface thereof; a developer carrier, having an internally fixed magnetic field generating device which rotates while holding a two-component developer comprising a magnetic carrier and a toner on the surface thereof to oppose the image carrier; and a developing electric field generating device which generates a developing electric field between the image carrier and the developer carrier. The electrostatic latent image on the image carrier is converted into a toner image by the action of the developing electric field, using the toner of the two-component developer held on the developer carrier. The photosensitive drum and the developing unit are integrated. The volume-average particle size of the toner is 5.5 through 8.0 (μm). The volume-average particle size of the magnetic carrier is 20 through 40 (μm). The gap between the image carrier and the developer carrier is 0.3 through 0.6 (mm). The tolerance of the gap is within ±0.125 (mm). The 0.2 through 0.7 (wt %) of hydrophobic silica having a particle size of 100 (nm) or above, 1.0 through 2.0

(wt %) of hydrophobic silica having a particle size of 20 (nm) or below, and 0.7 through 1.0 (wt %) of titanium oxide are added to the toner.

BRIEF DESCRIPTION OF THE DRAWINGS

The above and other objects, feature and advantages of the present invention will become more apparent from the following detailed description taken with the accompanying drawings in which:

FIG. 2 is a table showing evaluation standards for the granularity ranking in FIG. 1;

FIG. 3 is a table showing granularity rankings in a case where toner of three different particle sizes is used and the developing gap is varied;

FIG. 10 is a table showing the evaluation standards for the embedding ranks of large-particle toner;

FIG. 11 is a table showing evaluation standards for the embedding ranks of large-particle silica;

FIG. 12 is a table showing the relationship between the added amount of large-particle silica and the occurrence of filming on the photosensitive body;

FIG. 20 is a table showing the results of investigating the occurrence of problems of surface soiling in an example according to the present embodiment and respective comparative examples;

FIG. 24 is a table showing the relationship between the characteristics values of the image forming apparatus and image quality.

DESCRIPTION OF THE PREFERRED EMBODIMENTS

Below, embodiments of the present invention are described in detail.

First Embodiment

The first embodiment serves principally to achieve the first object of the present invention as described above.

Firstly, in order to respond to the recent demands for higher image quality in image forming apparatuses, as described above, the particle size of the toner and the magnetic carrier is reduced. This is described with reference to the drawings.

Figure 1:
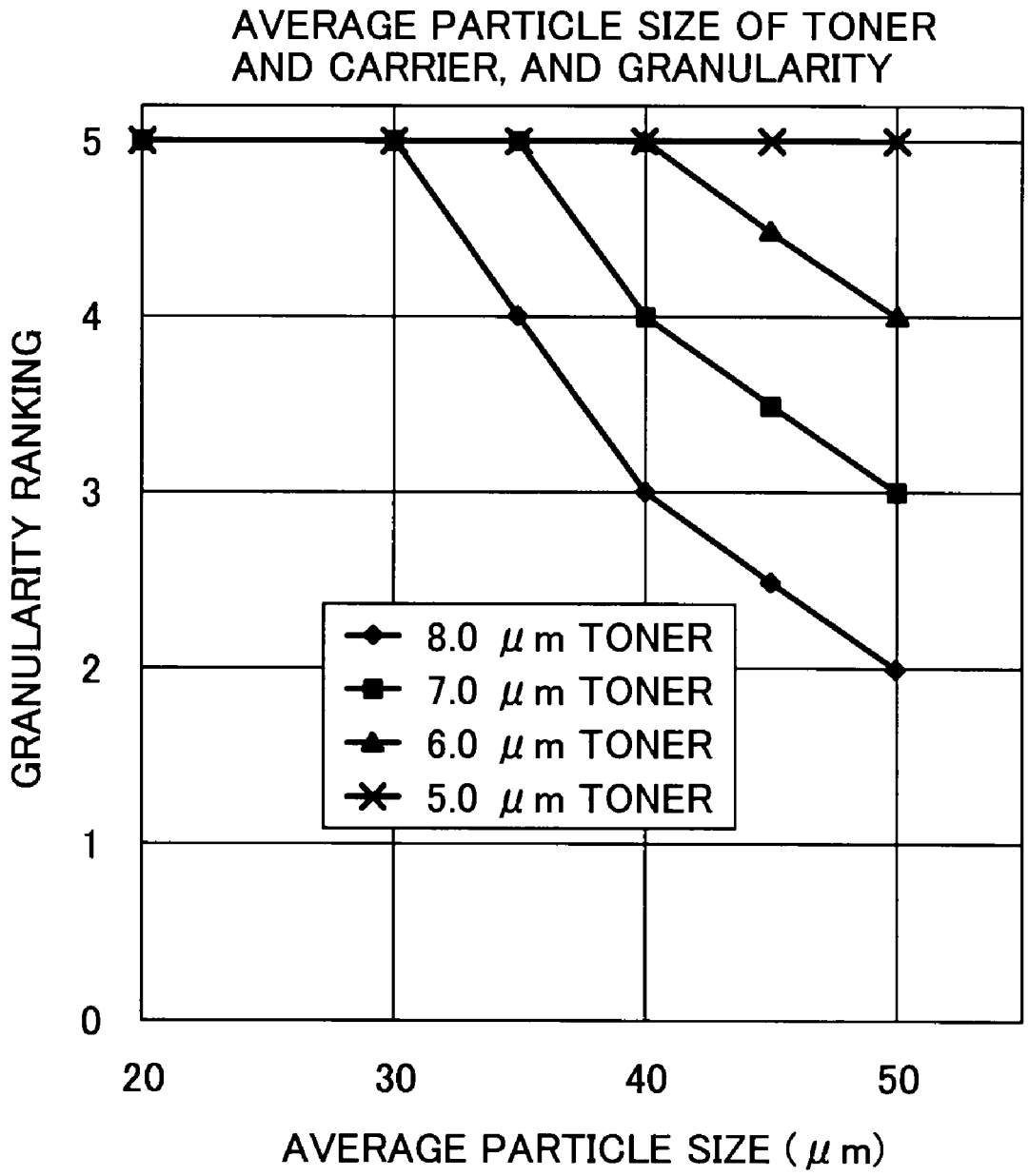
FIG. 1 is a graph showing the relationship between image quality and the particle size of toner and carrier, which form a developer used in an image forming apparatus.

FIG. 1 shows the relationship between the particle size of the toner and magnetic carrier, and the image quality (where the blurring of a dot is evaluated subjectively as the granularity.) In this case, the developer gap is 0.5 (mm). Furthermore, FIG. 2 shows the evaluation standards for the granularity ranking used in FIG. 1. The difference in image quality between the granularity rank 4 and granularity rank 5 in FIG. 2 is a difference in image quality that can be identified by using a magnifying glass, but cannot be distinguished by the naked eye.

Furthermore, FIG. 3 shows the granularity ranks achieved using toners of three different particle sizes, at various different values of the developing gap (Gp). In FIG. 3, the carrier has a particle size of 40 (μm). The higher the granularity rank, the lower the blurring of the dots, and the higher the image quality. From FIGS. 1 and 3, it can be seen that the smaller the particle size of the toner and carrier, and the smaller the developing gap, the better the granularity characteristics.

Next, the embedding of additive when using small-particle toner in order to improve the fluidity of the toner, as described above, will be explained with reference to FIGS. 4A and 4B.

Figure 4B:
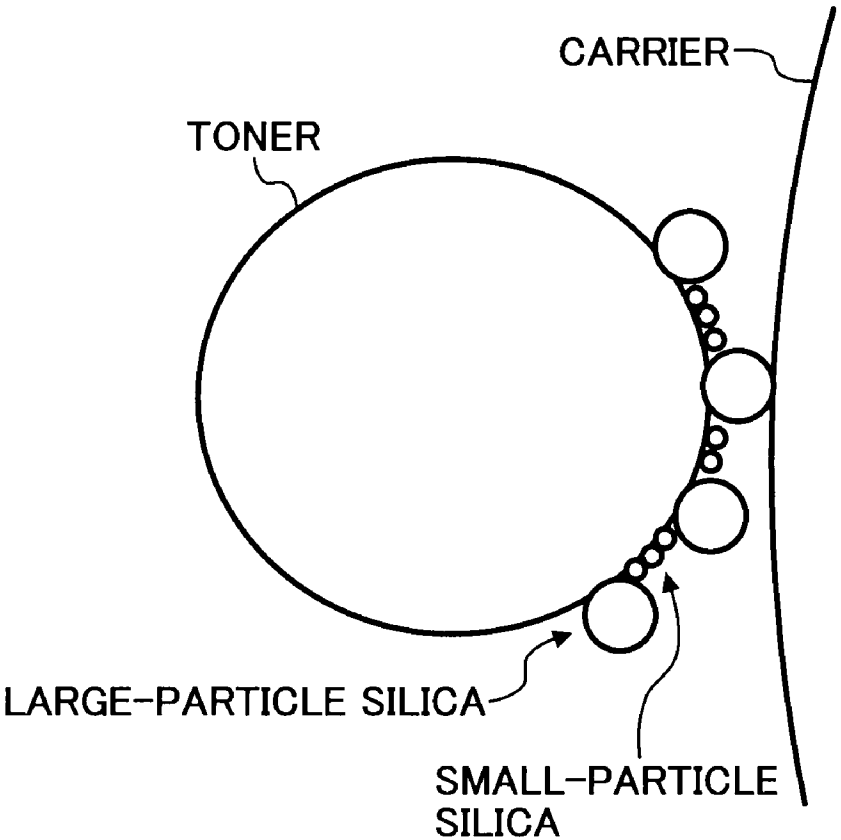
FIG. 4B is an enlarged diagram showing an aspect of toner particles and carrier particles when small-particle silica and large-particle silica are added to the toner.
Figure 4A:
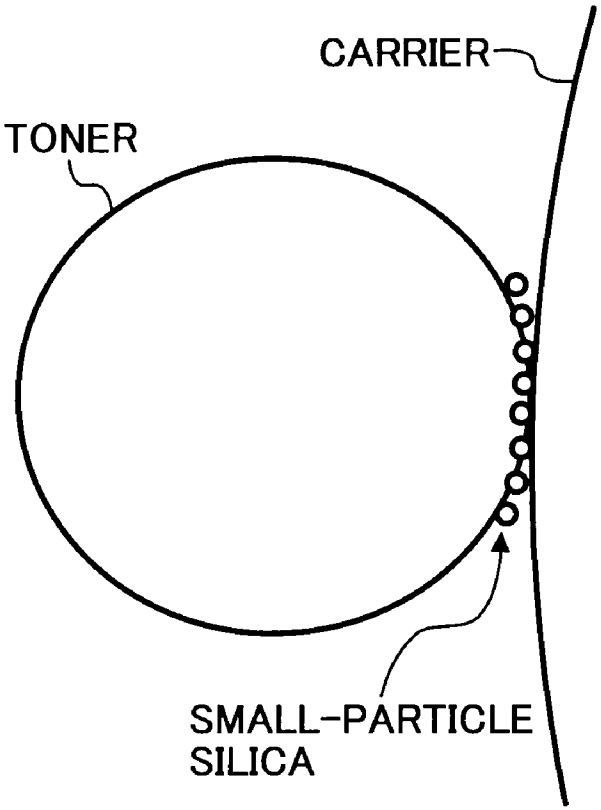
FIG. 4A is an enlarged diagram showing an aspect of toner particles and carrier particles when only small-particle silica is added to the toner.

FIG. 4A shows an enlarged view of a toner particle and a carrier particle in a case where only small-particle silica has been added. As described previously, silica added in order to improve fluidity has high hardness compared to the toner particles, and since it has a sufficiently small particle size compared to the toner particles and the carrier particles, the area of the contact surface with the toner particles is also small. If the area of the contact surface is small, then when a force is applied, the resulting pressure is not readily dispersed and therefore, the silica is liable to become embedded in the toner particles which are relatively soft compared to the silica. Consequently, if only small-particle silica is added, then when a toner particle and a carrier particle collide with each other and the resulting force is applied to the silica, the small-particle silica located between the toner particle and the carrier particle will readily become embedded in toner particle, as shown in FIG. 4A. Embedding of this kind does not only occur between a toner particle and a carrier particle, and may also occur between two toner particles.

On the other hand, if both large-particle silica and small-particle silica are used, then since the large-particle silica has a large particle size compared to the small-particle silica, the surface area of the contact surface with the toner will also be larger. If the area of the contact surface is large, then even if a toner particle and a carrier particle collide and a force of the same magnitude as that received by the small-particle silica described above is applied to the silica, the resulting pressure is dispersed and the silica is not liable to become embedded. Accordingly, the large-particle silica serves as a spacer, as shown in FIG. 4B. Since the large-particle silica serves as a spacer, it is possible to reduce the silica embedding action caused by small-particle silica located between a toner particle and a carrier particle, or between two toner particles.

Nevertheless, as described previously, specifying the added amount of the additive with respect to the toner is important in order to be able to form desirable images, and toner fluidity has a tendency to deteriorate, depending on the amount of additive.

Below, the first embodiment is described in detail with reference to the drawings.

Figure 5:
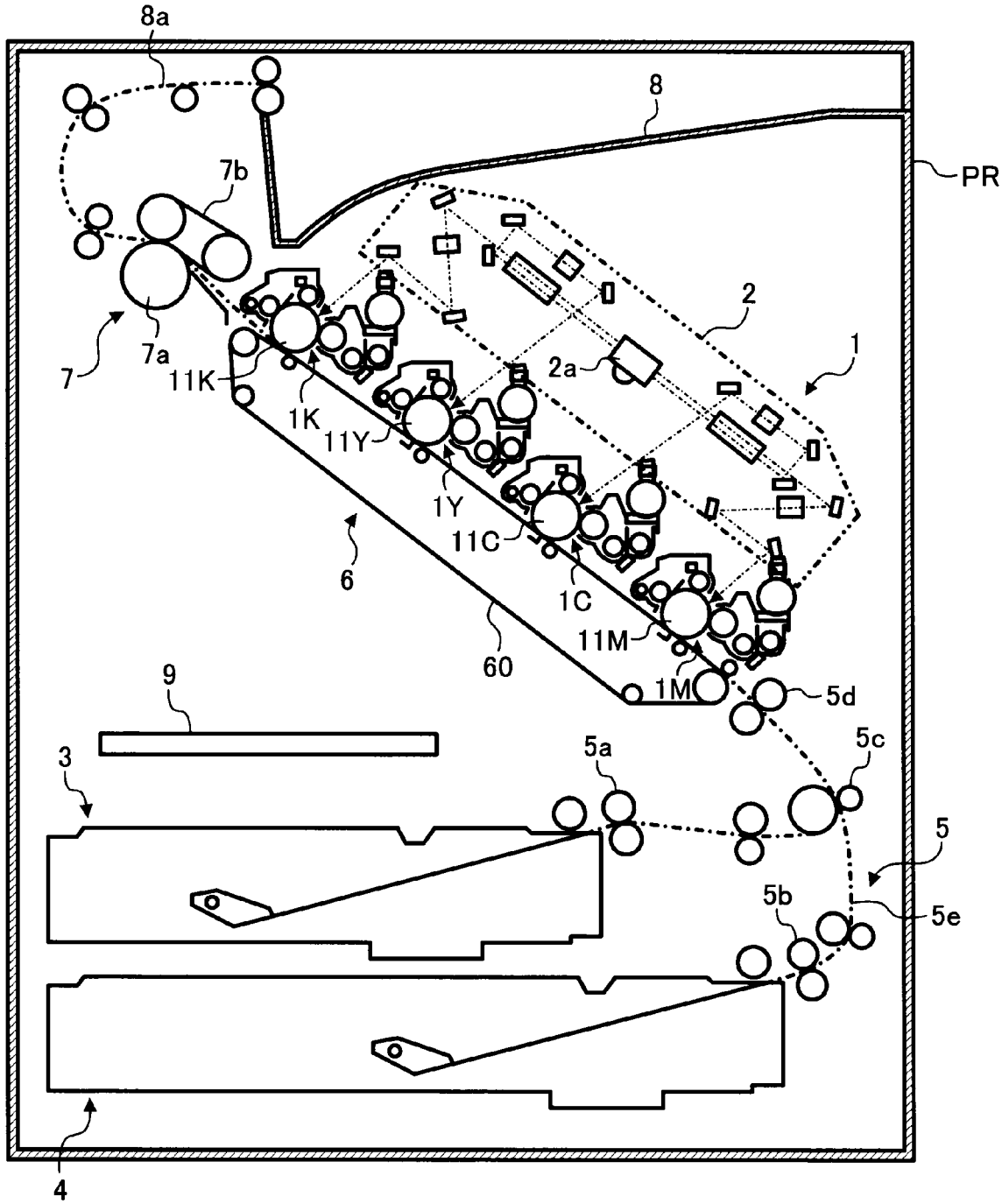
FIG. 5 is a general compositional diagram showing a color printer relating to a first embodiment of the present invention.

FIG. 5 is a diagram showing the general composition of a four-drum tandem color printer forming an image forming apparatus relating to the present embodiment.

This color printer PR basically comprises an image forming unit 1, an optical writing unit 2, first and second paper supply trays 3 and 4, a paper supply unit 5, a transfer unit 6, a fixing unit 7 and a paper output section 8. The color printer PR forms an image on the recording paper, which is the recording material supplied from the lower-positioned paper supply trays 3, 4, and it outputs the paper formed with the image to the paper output section 8, which is located in an upper position. The image forming unit 1 is constituted by four image forming stations 1M, 1C, 1Y and 1K. The first image forming station 1M, the second image forming station 1C, the third image forming station 1Y and the fourth image forming station 1K respectively form images using M (magenta) toner, C (cyan) toner, Y (yellow) toner and K (black) toner. These image forming stations 1M, 1C, 1Y and 1K are each composed in an individually detachable fashion with respect to the main body of the color printer PR. Therefore, maintenance tasks, such as replacement of components in the respective image forming stations 1M, 1C, 1Y and 1K, is facilitated.

Figure 6:
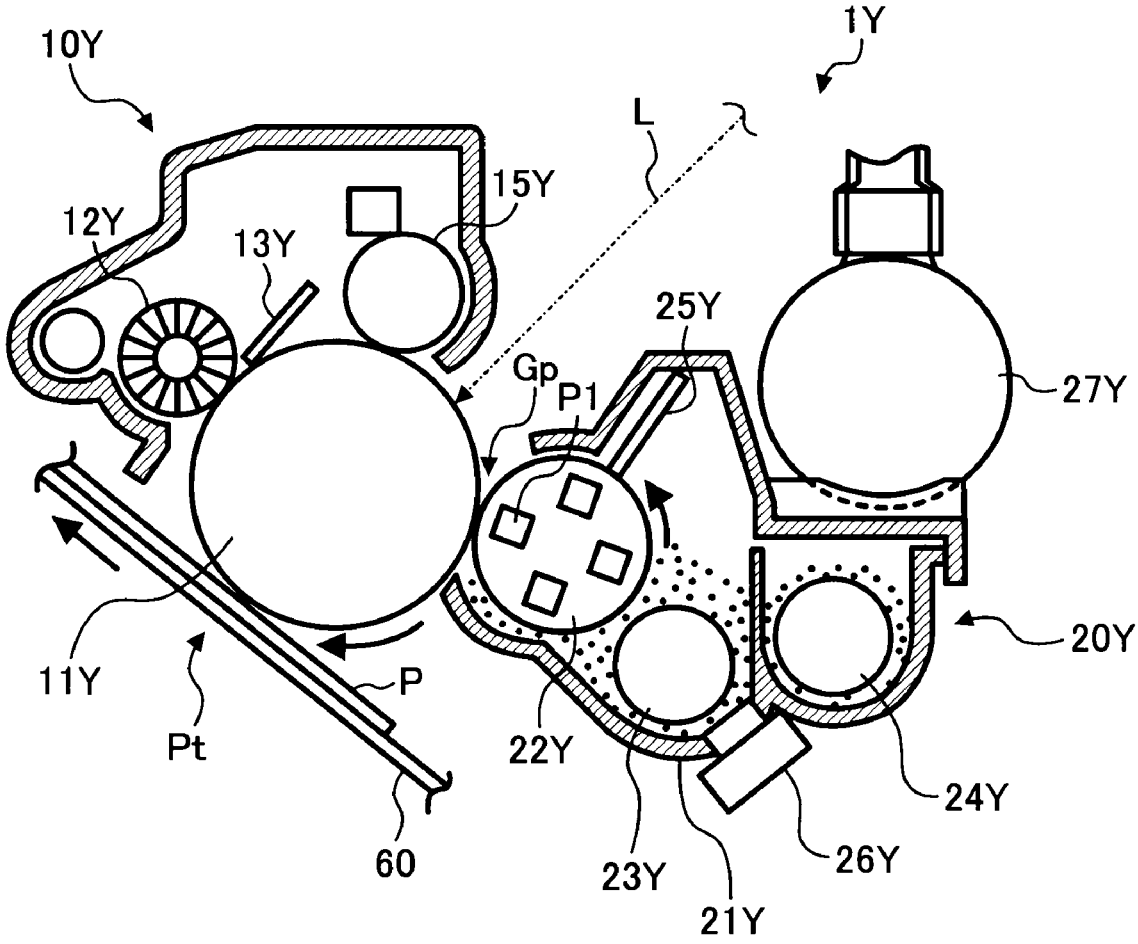
FIG. 6 is a diagram showing the detailed composition of a third image forming station of the color printer.

FIG. 6 shows the detailed composition of the third image forming station 1Y.

This third image forming station 1Y has a composition in which a charging and cleaning unit 10Y and a developing unit 20Y forming a developing device are located about the circumferential periphery of a photosensitive body 11Y which forms an image carrier. A laser light L for performing optical writing is irradiated onto the surface of the photosensitive body 11Y from between the charging and cleaning unit 10Y and the developing unit 20Y.

The charging and cleaning unit 10Y comprises a charging roller 15Y which forms uniform charging means, and a cleaning brush 12Y and separating hook 13Y which form cleaning means. The cleaning brush 12Y recovers residual toner from the photosensitive body 11Y, and any toner that is not recovered by this brush is separated by the separating hook 13Y, thereby returning the surface of the photosensitive body to a state ready for formation of the next image.

The developing unit 20Y basically comprises a developing sleeve 22Y, a churning roller 23Y, a conveyance roller 24Y, a doctor blade 25Y, a toner density sensor 26Y and a toner bottle 27Y. These elements are accommodated inside the developing tank 21Y or are installed on the developing tank 21Y. Toner supplied from the toner bottle 27Y to the developing tank 21Y is conveyed to the churning roller 23Y while being churned by the conveyance roller 24Y, and it is further churned by the churning roller 23Y. As a result of these churning actions, the toner is moved to the developing sleeve 22Y in a state where it has become charged by friction and acquired an electric potential. The toner moved onto the surface of the developing sleeve 22Y is restricted to a prescribed thickness by the doctor blade 25Y, and it is moved to a developing region opposing the photosensitive body 11Y by the rotation of the developing sleeve 22Y. In this developing region, the latent image formed by the optical writing stage described above is developed by the toner and converted into a toner image. In a transfer region facing the paper conveyance belt 60, which is the member that conveys the recording material, the toner image thus formed on the surface of the photosensitive body is transferred onto the recording paper P which is held on and conveyed by the paper conveyance belt. On the other hand, the toner remaining on the surface of the photosensitive body 11Y is recovered by the cleaning brush 12Y and further toner is removed from the surface of the photosensitive body 11Y by the separating hook 13Y.

Here, the third image forming station 1Y shown in FIG. 5 was described, but the same applies to the other stations 1M, 1C and 1K.

As shown in FIG. 5, the optical writing unit 2 uses a two-stage polygon mirror 2*a*, and comprises four independent optical writing paths for the respective four colors. As described above, this optical writing unit 2 performs optical writing by irradiating laser light onto the respective photosensitive bodies 11M, 11C, 11Y and 11K, from between the charging roller 15 and the developing sleeve 22 in each of the image forming stations 1M, 1C, 1Y and 1K.

The paper supply unit 5 is constituted by paper supply rollers 5*a* and 5*b* which pick up recording paper P from the paper supply trays 3 and 4, a paper supply roller 5*c* provided along the paper supply path 5*e*, and a resist roller 5*d* provided immediately before the image forming unit 1 on the upstream side thereof in the recording paper conveyance direction. The resist roller 5*d* is driven as a uniform surface area movement speed (linear resist speed) by drive means (not illustrated). In the present embodiment, this linear resist speed may be changed by a control unit (described later) which forms resist rotation speed modification means. When the setting of the linear resist speed is changed manually by an operator, the operator uses the keypad, or the like, provided on the color printer PR as input means, in order to input a desired setting value, whereupon the control unit as setting means changes the setting value of the resist speed in accordance with the set value. An external device, such as a personal computer (PC), may be connected to an external interface (input means) of the color printer PR, in such a manner that the setting value is input via the PC.

The resist roller 5*d* starts to transport the recording paper P in synchronism with the timing at which the leading edge of the toner image formed on the photosensitive body 11M of the first station 1M enters into the transfer region. The recording paper P delivered from the resist roller 5*d* is attracted onto the surface of the paper conveyance belt 60 and in this state, is conveyed due to the movement of the surface of the paper conveyance belt 60. During this conveyance operation, toner images of the respective colors formed respectively on the photosensitive bodies 11M, 11C, 11Y and 11K by the respective image forming stations 1M, 1C, 1Y and 1K are transferred successively onto the recording paper P in a mutually overlapping fashion. The recording paper P onto which the respective color toner images have been transferred is subsequently conveyed to a fixing unit 7, where fixing takes place. The fixing unit 7 is a commonly known device comprising a heating roller 7*a* and a fixing belt 7*b*, and the fixed recording paper P is output to the paper output tray 8 via the paper output path 8*a*.

Next, the developing unit 20Y is described in further detail.

This developing unit 20Y comprises a non-magnetic developing sleeve 22Y forming a developer carrier which holds, on its surface, a two-component developer (hereinafter called "developer") containing toner and a magnetic carrier. The developing sleeve 22Y is installed in such a manner that it is partially exposed at an opening formed on the photosensitive body 11Y side of the developer casing, and it is rotated by drive means (not illustrated). There is no particular limitation on the material of the developing sleeve 22Y, provided that it can be used in a normal developing unit, and non-magnetic material, such as stainless steel, aluminum, ceramic, or the like, or one of these materials provided with an additional coating, for instance, may be used. Furthermore, the shape of the developing sleeve 22Y is not limited in particular. Moreover, a magnetic roller comprising a group of fixed magnets which form magnetic field generating means is installed in a fixed position inside the developing sleeve 22Y. Furthermore, the developing unit 20Y comprises a doctor 25Y which is a developer restricting member made of a rigid body which restricts the amount of developer held on the developing sleeve 22Y. A developer accommodating unit which accommodates the developer is formed on the upstream side of the doctor 25Y in the direction of rotation of the developing sleeve, and a churning roller 23Y and a conveyance roller 24Y, which churn and mix the developer in the developer accommodating unit, are also provided.

In the developing unit 20Y having the aforementioned composition, the developer inside the developer accommodating unit is churned by rotation of the churning roller 23Y and the conveyance roller 24Y, and the toner and magnetic carrier particles are charged by friction to mutually opposite polarities. The developer is supplied onto the circumferential surface of the developing sleeve 22Y as it is driven in rotation, and the developer thus supplied is held on the surface of the developing sleeve 22Y and conveyed in the direction of rotation by the rotation of the developing sleeve 22Y. Subsequently, the quantity of the developer thus transported is restricted by the doctor 25Y, and the restricted developer is then conveyed to a developing region where the photosensitive body 11Y and the developing sleeve 22Y face each other. A developing bias is applied to the developing sleeve 22Y from a developing power supply (not illustrated) which forms developing field generating means, and consequently, a developing electric field is formed in the developing region and the toner particles in the developer are moved by electrostatic force onto the electrostatic latent image formed on the surface of the photosensitive body. Accordingly, the latent image is converted into a visible toner image.

The core material of the carrier in the present embodiment uses various types of ferrite particles, such as Zn—Cu ferrite, $Fe_3O_4$ magnetite, or the like. From the viewpoint of carrier adherence and high image quality, it is desirable that the weight-average particle diameter of the core material used in the carrier is 40 μm or less, the content of particles of size 22 μm or less is 1 to 2 (wt %) or less, and the saturation magnetization value is 70 (emu/g) or above. In respect of carrier adherence, desirably, the saturation magnetization value of the carrier in a magnetic field of $1\times10^7/4\Pi$ (A/m) (10 k (Oe)) should be $70\times10^{-7}\times4\,\Pi$ (Wb·m/kg) (70 (emu/g)) or greater. A BHU-60 magnetization measurement device (made by Riken Denshi Co. Ltd.) is used for measuring the magnetization characteristics of the carrier. To give specific details, a measurement sample of approximately 1.0 g was weighed, enclosed in a cell of internal diameter 7 (mm) and height 10 (mm), and then set in the aforementioned measurement device. During measurement, a magnetic field was gradually applied and increased up to a maximum of $1\times10^7/4\Pi$ (A/m). Thereupon, the applied magnetic field was reduced, and finally, a hysteresis curve for the sample was obtained on a sheet of recording paper. From this, the saturation magnetization value was determined. The distribution of the particle characteristics of the carrier were measured using an SRA type "Microtrac" particle size analyzer (made by Nikkiso Co., Ltd.), in a range setting of 0.7 to 125 (μm).

The mechanical conditions of the full color printer according to the present embodiment are as given below.

| | |
|---|---|
| Linear speed | 125 (mm/sec) |
| Diameter of photosensitive body | 30 (mm) |
| Linear speed ratio between sleeve and photosensitive body | 2.0 |
| Gap between photosensitive body and developing sleeve (Gp) | 0.4 (mm) |
| Gap between developing sleeve and doctor (doctor gap: Gd) | 0.55 (mm) |
| Developer drawn amount | 60 (mg/cm$^2$) |
| Sleeve diameter | 18 (mm) |
| Roller surface | V groove (No. of grooves: 100; Groove depth (perpendicular): 70 (μm)) |
| Angle of main pole | 7 (°) |
| Magnetic flux density at main pole | 100 (mT) |
| Magnetic flux density at doctor | 70 (mT) |
| Charging potential V0 | −520 (V) |
| Potential after exposure VL | −50 (V) |
| Developing bias VB (DC) | −400 (V) |

The doctor 25Y is made of a material which is rigid and magnetic. The doctor 25Y is not limited to one made of a metallic material, such as iron, stainless steel, or the like, and it is also possible to compose it of a resin material containing a mixture of magnetic particles of ferrite, magnetite, or the like. Moreover, rather than making the doctor 25Y from a magnetic material, it is also possible to obtain similar beneficial effects by fixing a separate member, such as a metal plate made of a magnetic material, onto the doctor 25Y, either directly or indirectly.

(Powdered Toner in Comparative Example)

| | |
|---|---|
| Styrene-acrylic resin (Hymer 75, made by Sanyo Chemical Industries, Ltd.) | 85 parts |
| Carbon black (No. 44, made by Mitsubishi Chemicals) | 8 parts |
| Metallic azo dye (Bontron S-34; made by Orient Chem. Co. Ltd.) | 2 parts |
| Carnauba wax (WA-03; made by Cera Rica Noda Co., Ltd.) | 5 parts |

The materials listed above were melted and kneaded using a hot roll at 140° C., whereupon the mixture was cooled and solidified, and crushed and broken into particles in a jet mill, to obtain a toner having an average particle size of 7.0 μm. Thereupon, 1.0 (wt %) of hydrophobic silica (R-972) (small-particle silica having a particle size of 16 nm) was added with respect to every 100 parts by weight of toner, and mixed in a Henschel mixer.

The carrier used in the present embodiment was as described below (Carrier according to present embodiment)

| | |
|---|---|
| Acrylic resin solution (solid content 50 (wt %)) | 56.0 parts |
| Guanamine solution (solid content 77 (wt %)) | 15.6 parts |
| Toluene | 900 parts |
| Butylcellosolve | 900 parts |

The compounds listed above were dispersed in a homomixer for 10 minutes, to prepare a film forming solution, which was then coated onto a core material comprising calcined ferrite powder (average particle: 35 (μm) (made by Powdertech Corp.), to a film thickness of 0.15 (μm), in a Spiracoater (made by Okada Seiko Co. Ltd.), and the film was dried. The carrier thus obtained was calcined for one hour at 150° C. in an electric furnace. The weight-average carrier size was 35 (μm).

(Toner According to Present Embodiment)

The toner according to the present embodiment is obtained by dissolving or dispersing a prepolymer comprising a modified polyester resin, a compound which extends or cross-links the prepolymer, and a toner component, in an organic solvent, causing the dissolved or dispersed material thus obtained to undergo a cross-linking reaction and/or extending reaction in an aqueous medium, and then removing the solvent from the dispersion thus obtained.

More specifically, the toner according to the present embodiment is obtained by preparing an oil-based dispersion in which, at the least, a polyester prepolymer A containing an isocyanate group is dissolved in an organic solvent, a pigment-based coloring material is dispersed and a release agent is dissolved or dispersed, dispersing this oil-based dispersion in an aqueous medium in the presence of inorganic microparticles and/or polymer microparticles, and furthermore, forming a urea-modified polyester resin C having a urea group by reacting the aforementioned prepolymer A with a polyamine and/or a monoamine B having a group containing active hydrogen, in the dispersion, and then removing the liquid medium from the dispersion which contains this urea-modified polyester resin C.

In the urea-modified polyester resin C, the Tg value is 40 to 64° C., and desirably, 45 to 60° C. The number-average molecular weight Mn is 2500 to 50,000, and desirably, 2500 to 30,000. The weight-average molecular weight Mw is 10,000 to 500,000, and desirably, 30,000 to 100,000.

This toner includes, as a binder resin, a urea-modified polyester resin C having urea bonds of high molecular weight due to the reaction between the prepolymer A and the amine B. The coloring agent is dispersed to a high degree within this binder resin. Hydrophobic silica R-972 (small-particle silica, having a particle size of around 16 (nm)) (made by Japan Aerosil Co.) was combined at a ratio of 2.0 (wt %) to every 100 parts by weight of toner, in a Henschel mixer. The combined toner in this embodiment was obtained by combining the following materials with the toner base material obtained above, in a Henschel mixer: hydrophobic silica (small-particle silica, having a particle size of around 120 (nm)), X24-9163A (made by Shin-Etsu Chemical Co., Ltd.), at a ratio of 0.2 to 0.7 (wt %) (0.5 (wt %) unless specified otherwise); hydrophobic silica (small-particle silica, having a particle size of around 10 (nm)), H2000 (made by Clariant Japan), at a ratio of 1.0 to 2.0 (wt %) (1.5 (wt %) unless specified otherwise); and hydrophobic titanium oxide MT 150AI (made by Teika Co.), at a ratio of 0.7 to 1.0 (wt %) (1.0 (wt %) unless specified otherwise).

(Manufacture of Developer)

A developer was manufactured by mixing 7 parts of the aforementioned toner and 93 parts of the aforementioned carrier for 10 minutes in a tumbler mixer.

Next, the numerical ranges which are specified conditions in the present embodiment were investigated, in combination with the developer according to the comparative example described above, and the device according to the present embodiment.

Firstly, the relationship between the upper limit of the volume-average particle size of the toner and the carrier diameter, as determined on the basis of image quality, was investigated.

From FIGS. 1 and 3, it can be seen that by taking the average particle size of the toner to be 5.5 to 8.0 (μm), the volume-average particle size of the magnetic carrier, to be 20 to 40 (μm), the gap between the image carrier and the developer carrier, to be 0.3 to 0.6 (mm), and the tolerance to be within ±0.125 (mm), then it is possible to form images of high quality of rank 2.5 in the aforementioned granularity ranking.

However, in order to achieve yet higher image quality, rank 4 based on subjective visual evaluation is considered to be the quality achievement standard. An inspector compared the sample image with model specimens for ranks 1 to 5, and decided the rank of the sample accordingly. 4.5 indicates an image which is of better quality than rank 4 but inferior to rank 5.

In the case of toner having a particle size of 7.0 (μm), it can be seen that the granularity rank 4 can be achieved with a carrier particle size of 20 to 40 (μm).

In the case of toner having a particle size of 8.0 (μm), it can be seen that the granularity rank 4 can be achieved with a carrier particle size of 20 to 35 (μm).

Furthermore, when the relationship with the developing gap is investigated, the following findings can be derived from Table 2. Here, the carrier particle size is 40 (μm).

In the case of toner having a particle size of 6.0 (μm), a granularity rank of 4.5 can be achieved if the developing gap is 0.6 (mm) or less.

In the case of toner having a particle size of 7.0 (μm), a granularity rank of 4 can be achieved if the developing gap is 0.5 (mm) or less.

In the case of toner having a particle size of 8.0 (μm), a granularity rank of 4 can be achieved if the developing gap is 0.4 (mm) or less.

The smaller the particle size of the crushed toner, the greater the crushing energy consumed in the manufacturing stages. From the viewpoint of saving energy, it is not possible to increase the crushing energy limitlessly, and recently there has been a trend toward using polymerized toner in which the particle size can be controlled readily (which makes small-particle toner easier to manufacture). However, the polymerized toner has small indentations compared to crushed toner of the same particle size, and hence the toner additive becomes embedded more readily, and deterioration of toner fluidity is more liable to occur over time.

Figure 7:
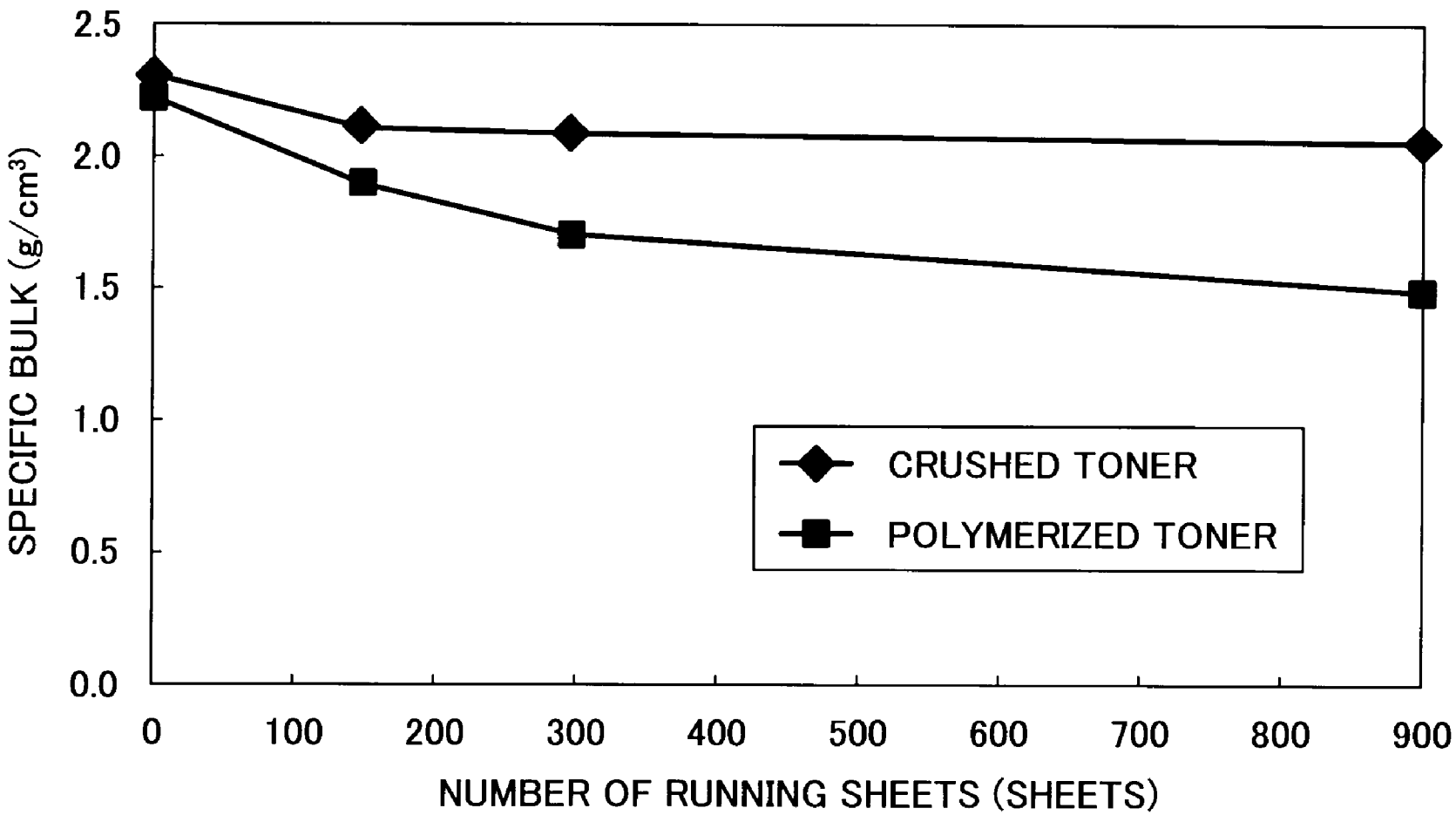
FIG. 7 is a graph showing the change over time in the drawn amount of crushed toner, polymerized toner, and small-particle silica.

As an indicator of the deterioration of fluidity when the additive has become embedded, which is a problem arising from the reduction in particle size of the toner and carrier, FIG. 7 shows the results of deterioration of the bulk density of the developer over time for a crushed toner (average particle size by volume: 7.0 (μm)) and a polymerized toner (average particle size by volume: 6.0 (μm)), when using a V grooved developing roller and small-particle carrier (average particle size of 35 (μm)). The bulk density is used as an indicator because the bulk density tends to decline when the fluidity of a powder, which is one of the general characteristics of a powder, deteriorates. It can be seen that the decline in the bulk density of the developer over time is greater in the case of the polymerized toner than the crushed toner. The decline of the bulk density of the developer is thought to be caused by the deterioration of toner fluidity due principally to embedding of additive into the toner.

Next, a description is given with respect to surface soiling, which is another problem caused by the phenomenon of embedding of the toner additive over time, which causes deterioration of fluidity.

Since the additive in the toner also serves to maintain the charging capacity of the toner, if the additive becomes embedded, then this action is lost, the toner approaches the original charging capacity of the base toner, and hence there is a sensation that the charging capacity has fallen. Consequently, surface soiling occurs due to an increase in weakly-charged toner. When forming a plurality of images of low image surface area, only a small amount of new toner is supplied, and therefore, the decline in the charging capacity due to embedding of the additive is particularly notable.

Figure 8:
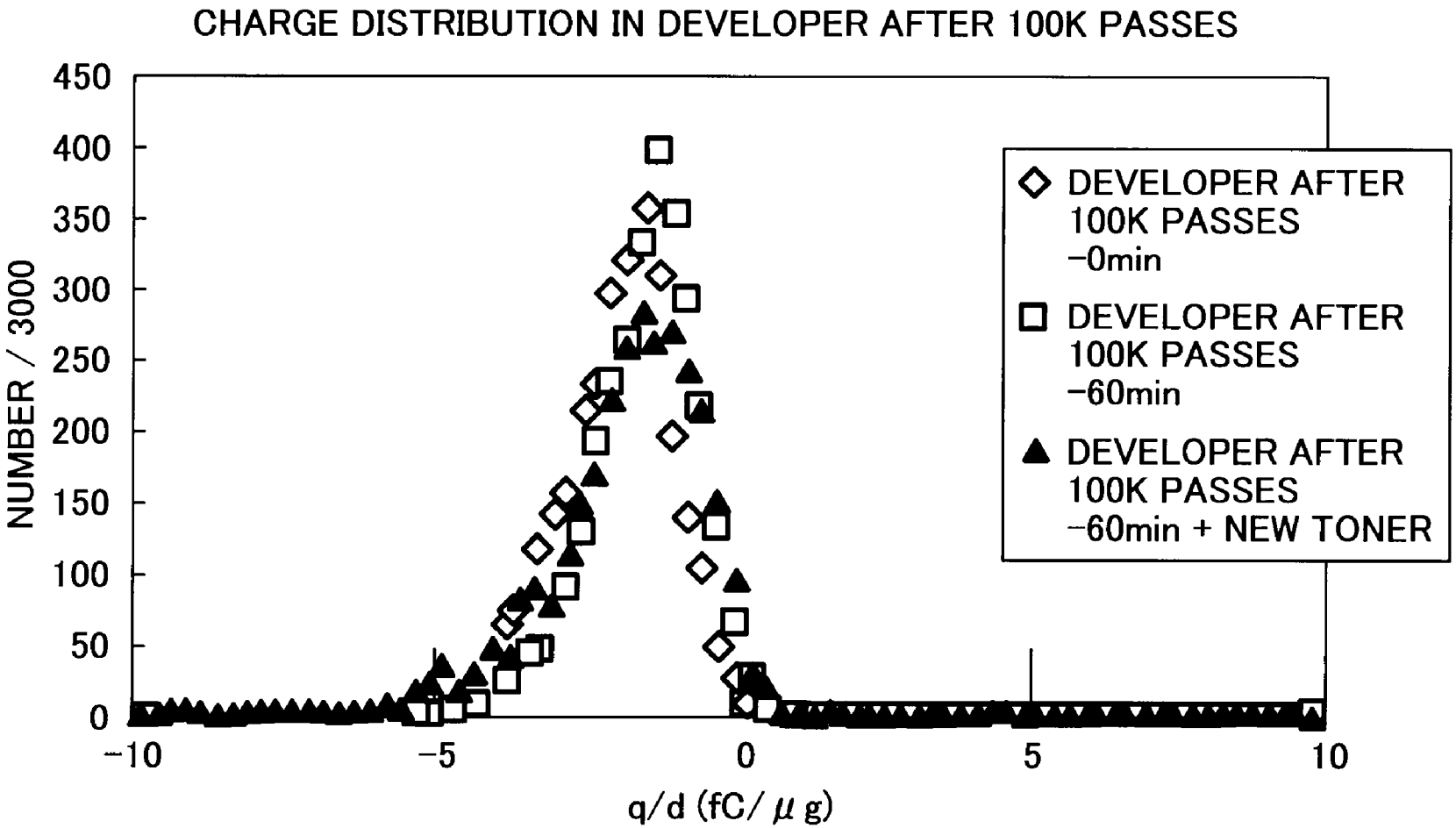
FIG. 8 is a graph showing the charge distribution of the toner in the developer after forming 100,000 images.

FIG. 8 shows the charge distribution of the toner in the developer after forming 100,000 images. This charge distribution was measured with an "E-Spart" analyzer (registered trademark) made by Hosokawa Micron Co., Ltd. The diamond-shaped dots in the diagram correspond to developer after printing 100,000 sheets at a general image surface area of approximately 5%, and in this case, there is little weakly-charged toner. On the other hand, the square-shaped dots in the diagram show the results of measuring the charge distribution of the developer after churning the developer indicated by the diamond-shaped dots, for 60 minutes. In this case, it can be seen that the amount of weakly-charged toner (component approaching a charge of zero) is increased in comparison with the case of the diamond-shaped dots. Furthermore, the surface soiling of the photosensitive body was transferred onto tape and the reflective density of the tape was measured, in the case of both the diamond-shaped dots and the square-shaped dots. In the case of the diamond-shaped dots, the value is 0.015 (good), and in the case of the square-shaped dots, the value is 0.046 (poor). Therefore, it can be seen that, the greater the amount of weakly-charged toner, the greater the amount of surface soiling that occurs. The measurement value indicates the actual value corresponding to the surface soiling, after subtracting the value corresponding to the tape. Below, this value is called "ΔID".

In Japanese Patent Laid-open No. 2003-426681, the present inventors prevent surface soiling when passing paper having a small image surface area, by using a sandblasted sleeve. However, the indentations on the surface of the sandblasted sleeve proceed to wear away over time, and hence this type of sleeve is not suitable for a developing device designed to have a long lifespan. If the amount of silica is increased in order to improve the fluidity of the toner, then problems also arise in that the silica comes away from the surface of the toner, and creates filming on the photosensitive body.

Figure 9:
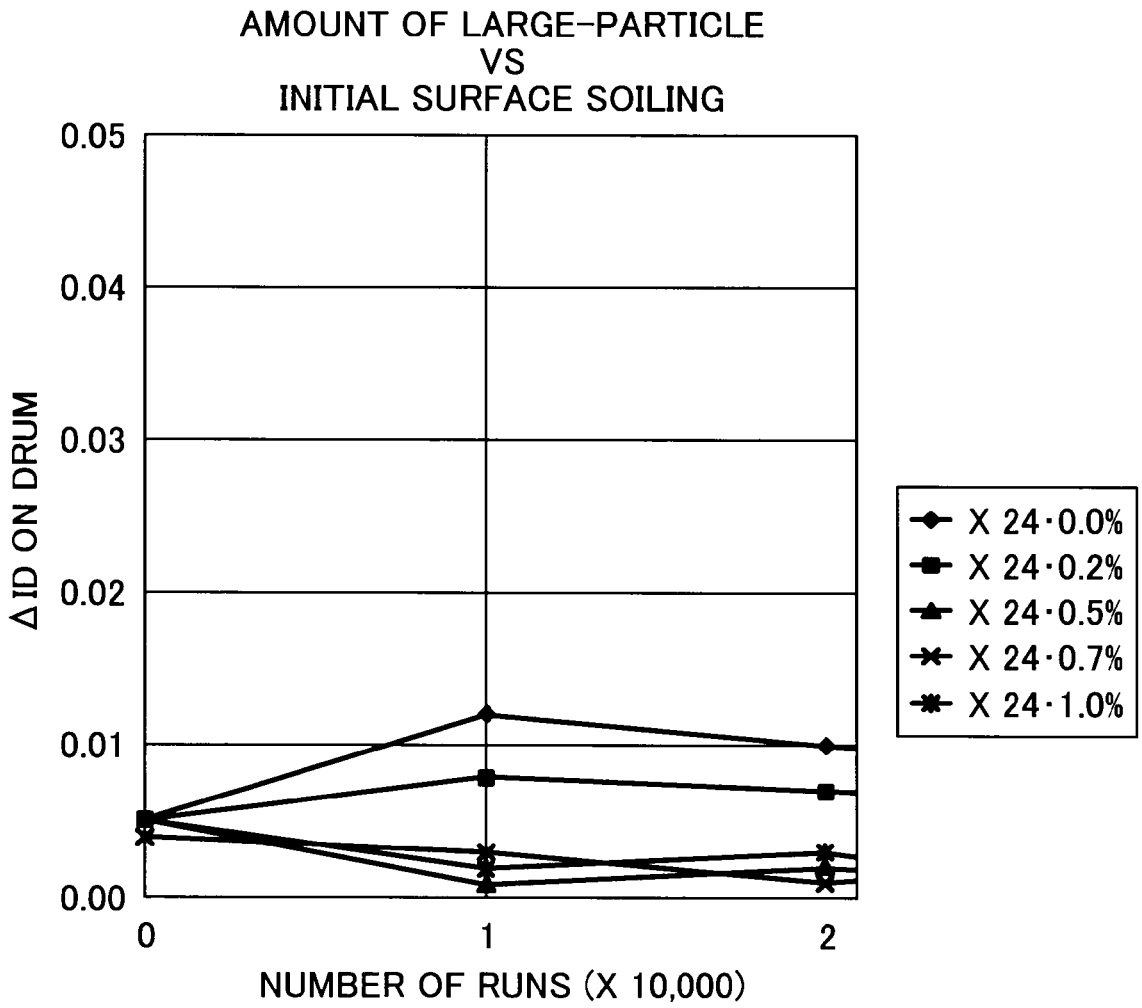
FIG. 9 is a graph showing the correlation between the added amount of large-particle silica hydrophobic silica and the initial surface soiling due to running of the machine.

In order to prevent surface soiling of the kind described above, in the present embodiment, large-particle silica is added. FIG. 9 is a graph showing the correlation between the amount of hydrophobic silica having a particle size of 100 (mn) or above and the initial surface soiling due to running of the machine. In this case, the toner is a polymerized toner having an average particle size by volume of 6.0 (μm), and a carrier having a particle size of 35 (μm) is used. Furthermore, small-particle silica (H2000) having a particle size of 20 (μm) or less was added at a ratio of 2.0 (wt %).

The value of ΔID on the drum is the value indicating the difference with respect to a position where there is no surface soiling when the material on the photosensitive body drum is transferred onto a tape, and provided that ΔID is 0.01 or less, then no problem arises.

If there is absolutely no large-particle silica (X24-9163A), then surface soiling due to the embedding of small-particle silica is aggravated.

If large-particle silica (X24-9163A) is incorporated at a ratio of 0.2 (wt %) or more with respect to the toner, then the large-particle silica acts as a spacer, and makes the small-particle silica less liable to become embedded. Therefore, the adhesive force between respective toner particles and the adhesive force between toner particles and carrier particles is reduced, and consequently, toner fluidity can be maintained at a good level over time, even if a combination of small-particle toner and small-particle carrier is used, and toner dispersion into the developer can proceed smoothly. As a result, the start-up characteristics of (Q/M) due to the sharp charging action on the developer caused by the restricting member on the developing sleeve (known as the "doctor") are improved, and surface soiling (including soiling caused by the occurrence of weakly-charged toner), and soiling caused by large particles, can be reduced significantly.

Next, the particle size of the large-particle silica was investigated by freely churning silica of various different sizes, and seeing whether the state of embedding of the silica, as expressed as an embedding rank, made it suitable for use.

FIG. 10 shows evaluation standards for embedding ranks, and FIG. 11 shows embedding ranks for various particle sizes when one type of silica is added as large-particle silica, at a ratio of 0.5 (wt %). Material having an embedding rank of 4 was considered suitable for use in an actual device.

From FIG. 10 and FIG. 11, it can be seen that if the silica particle size is 50 (μm), then the embedding rank is 3, which means that the material is not suitable for use, whereas if the silica particle size is 100 (μm) or above, then the embedding rank is 4, and hence the material is suitable for use.

If the added amount of large-particle silica (X24-9163A) is too large, then not all of the large-particle silica will adhere to the surfaces of the toner particles, and the surplus silica will give rise to filming on the photosensitive body.

FIG. 12 shows the relationship between the added amount of large-particle silica and the occurrence of toner filming on the photosensitive body when 1000 sheets are printed in an actual machine. The particle sizes and added amounts apart from the added amount of large-particle silica are the same as those shown in FIG. 9.

If the amount of large-particle silica is increased up to 1.0 (wt %) then filming occurs on the photosensitive body, but filming does not occur if it is increased until 0.7 (wt %).

From this, it can be deduced that the added amount of large-particle silica should desirably be 0.7 (wt %) or less.

Next, the added amount of small-particle silica (H2000) for maintaining toner fluidity was investigated.

Figures 13, 14, 15:
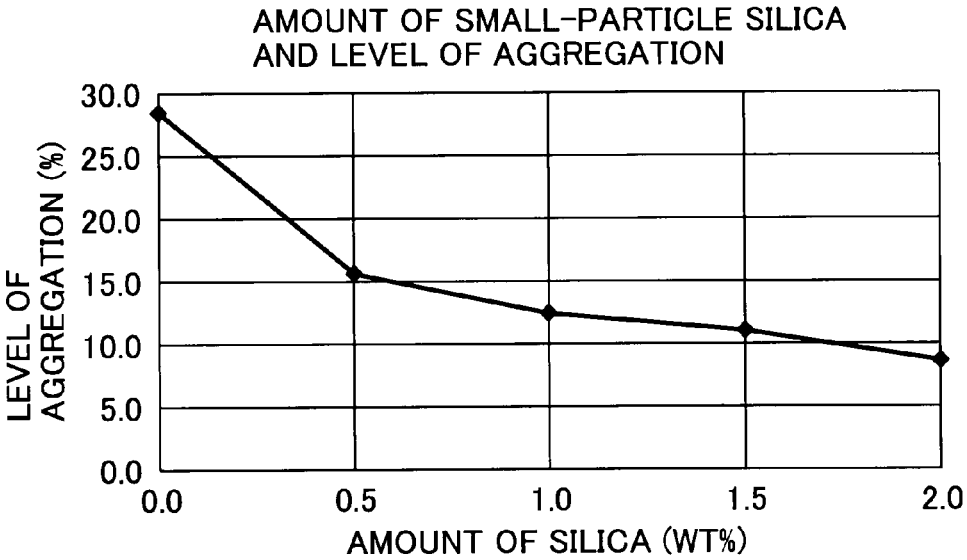
FIG. 13 is a graph showing the relationship between the added amount of small-particle silica and the level of aggregation.
FIG. 14 is a table showing the embedding ranks of small-particle silica in a case where 0.5 wt % of large-particle silica of 120 nm is added.
FIG. 15 is a table showing the relationship between the added amount of small-particle silica and the occurrence of filming.

FIG. 13 contains graphs showing the relationship between the added amount of hydrophobic silica (H2000) of particle size 20 (nm) or less and the level of aggregation, when using polymerized toner having a weight-average particle size of 6.0 (μm) and a carrier having an average particle size of 35 (μm). The added amount of large-particle silica (X24-9163A) is 0.2 (wt %). The level of aggregation is a value which indicates the ratio of residual toner left when the toner is passed through a mesh, and the larger the figure, the greater the level of aggregation and the worse the state of fluidity of the toner.

If an aggregation level of 12.5% is taken as the lower limit at which toner is re-supplied in the present device, then it can be seen that a desirable value is obtained, even when 1.0 (wt %) of silica is combined with the small-particle toner and small-particle carrier.

Next, the particle size of the small-particle silica was investigated by freely churning silica of various different sizes, and seeing whether the state of embedding of the silica, as expressed as an embedding rank, made it suitable for use.

The evaluation standards for embedding ranks are as shown in FIG. 10, and FIG. 14 shows embedding ranks for various particle sizes of the small-particle silica, when 0.5 (wt %) of silica having a particle size of 120 (μm) was added as large-particle silica. Small-particle silica having an embedding rank of 3 was considered suitable for use in an actual device.

According to FIG. 14, if the particle size of the small-particle silica is 30 (μm) or above, then the embedding rank becomes 2 or lower, and the silica is not suitable for use. It can be seen that if the particle size of the small-particle silica is 20 (μm), then the embedding rank become 3 and the silica is suitable for use.

Similarly to the large-particle silica (X24-9163A), if the added amount of the small-particle silica (H2000) is too large, then not all of the silica will adhere to the surfaces of the toner particles, and the surplus silica will cause filming on the photosensitive body.

FIG. 15 shows the relationship between the amount of small-particle silica and the occurrence of filming on the photosensitive body caused by silica and toner after passing 5000 sheets with the machine situated in a low-humidity environment. The particle sizes and added amounts apart from the added amount of the small-particle silica are the same as those in FIG. 13.

Furthermore, filming on the photosensitive body due to the addition of an excessive amount of large-particle silica is caused by the large-particle silica itself adhering directly to the photosensitive body. On the other hand, filming on the photosensitive body caused by addition of an excessive amount of small-particle silica is caused by the small-particle silica adhering to the photosensitive body and forming kernels onto which the toner particles become attached.

From FIG. 15, it can be seen that filming on the photosensitive body does not occur up to a value of 2.0 (wt %) for the added amount of small-particle silica.

Since the toner becomes charged up readily when small-particle toner is used, over-charged toner occurs amongst the toner, particularly in low-humidity conditions, and the electrostatic charge of the carrier is spent, leading to a reduction in charging sites and the occurrence of surface soiling in cases where supplied toner has not been charged.

This problem is alleviated in the present embodiment by adding a suitable amount of titanium oxide to the toner. The addition of titanium oxide restricts excessive charging of the toner, and therefore surface soiling is improved, even in a low-humidity environment.

Figure 16:
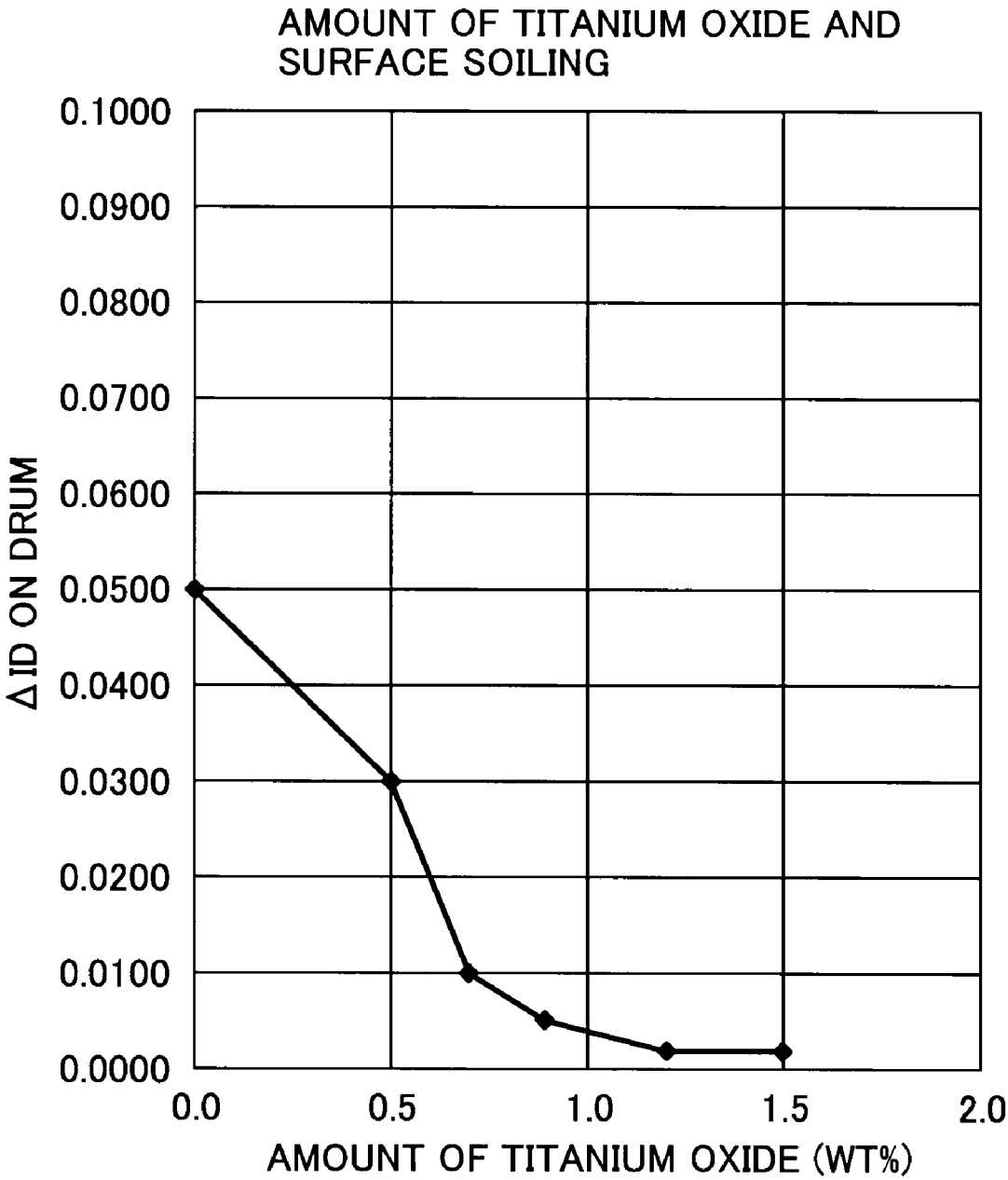
FIG. 16 is a graph showing the correlation between the added amount of titanium oxide and surface soiling.

FIG. 16 is a graph showing the relationship between the added amount of titanium oxide and the surface soiling that occurs, when a polymerized toner having a weight-average particle size of 6.0 (μm) and a carrier having an average particle size of 35 (μm) are used in a low-humidity environment (temperature: 10° C.; humidity 15%).

From FIG. 16, it can be seen that, at a titanium oxide content of 0.7 (wt %) or above, desirable results for surface soiling on the photosensitive body can be obtained, even when small-particle toner and small-particle carrier are combined.

The titanium oxide restricts excessive charging of the toner, but since it acts to suppress the amount of charge, the charge of the toner will decline over time if too much titanium oxide is added.

Figure 17:
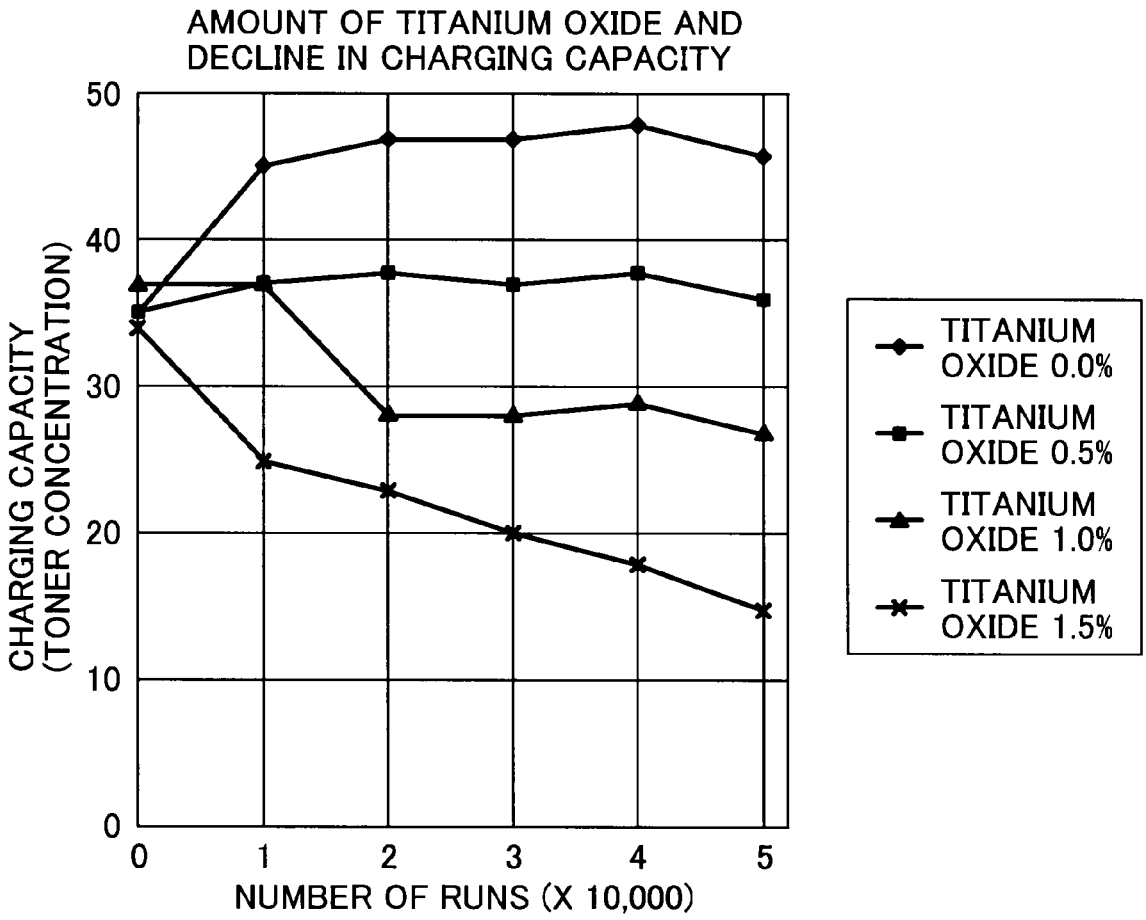
FIG. 17 is a graph showing the correlation between the added amount of titanium oxide and the decline in the charging capacity of the toner.

FIG. 17 is a graph showing the relationship between the added amount of titanium oxide and the decline in toner charge.

The amount of charge of the developer is indicated by DA (μC/g). (This is a value indicating the level of charge of the developer. In an actual machine, the toner density is controlled and modified, and it is not possible simply to consider the charging level of the developer with respect to operating time. In order to cancel out the variations in toner density caused by the control procedure, the inverse proportional relationship between the toner density and (Q/m) is used, and the toner density and (Q/M) are multiplied together and then divided by the initial toner density value of the developer: in other words, (toner density (wt %) Q/M (μC/g))/7 (wt %)). When the amount of charge is expressed in these terms, it can be seen that the charge ceases to fall with operation of the machine, up to an added amount of 1.0 (wt %) for the titanium oxide, but it continues to fall if the added amount is increased to 1.5 (wt %).

In order to improve image quality, desirably, the toner particle size is small, but if the particle size is too small, then surface soiling becomes more liable to occur.

Figures 18, 19:
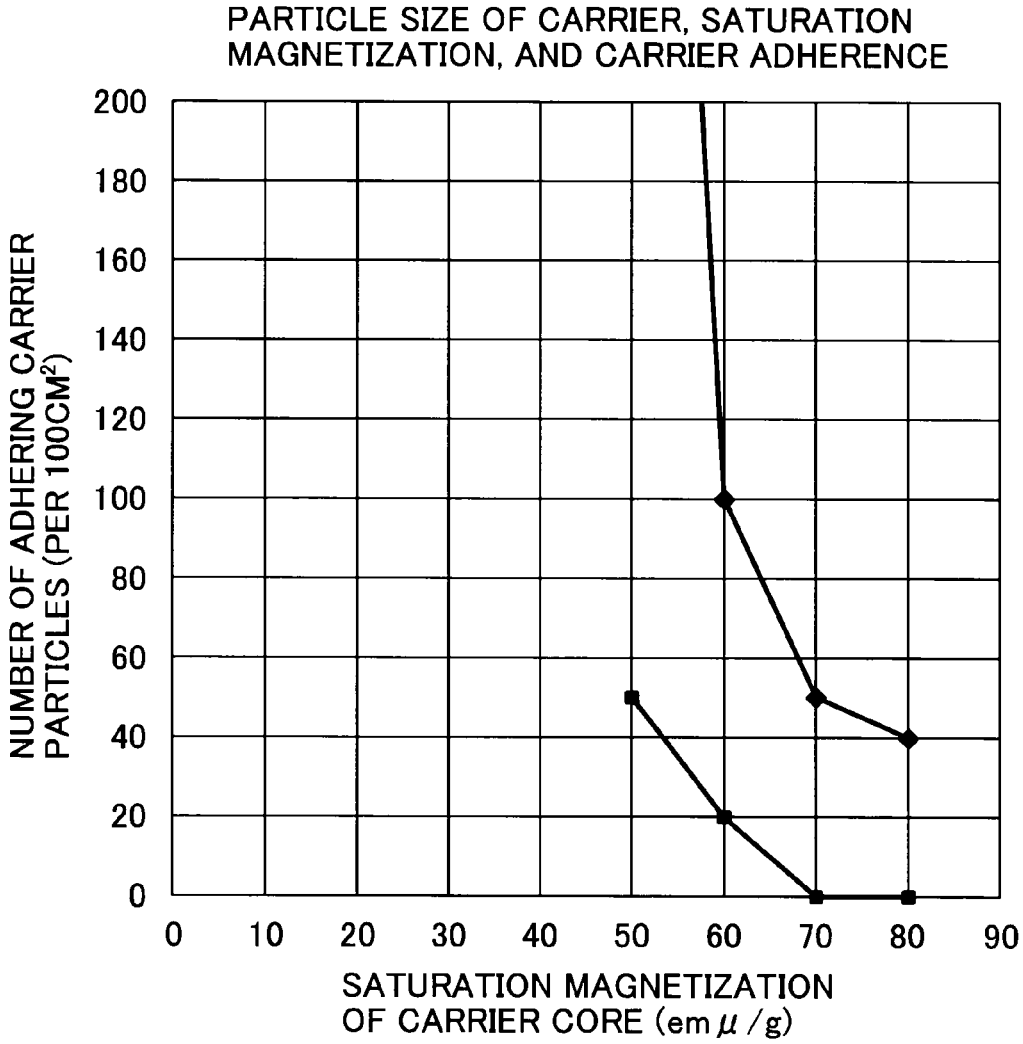
FIG. 18 is a table showing the level of surface soiling when images having a low image surface area are formed.
FIG. 19 is a graph showing the relationship between the magnetization of the carrier core material, the particle size and the adherence of carrier.

FIG. 18 shows the level of surface soiling when paper having a low image surface area is passed, for different toner particle sizes, and in the presence or absence of large-particle silica. The particle size of the carrier is 35 (μm) and the added amount of the large-particle silica is 0.5 (wt %). 500 sheets of paper of A4 size were passed consecutively, at a low image surface area of 0.5(%) of the total image surface area. Thereupon, the material on the photosensitive body was transferred onto a tape, and the differential (ΔID) with respect to the value for the tape alone was found, thereby indicating the amount of surface soiling (the smaller the figure, the lesser the amount of surface soiling).

It can be seen that the larger the toner particles, the lower the level of surface soiling in the case of a low image surface area. Furthermore, the level of surface soiling is lower when large-particle silica is added, compared to when large-particle silica is not added. If it is considered that there is virtually no problem provided that the ΔID value on the photosensitive body is less than 0.010, accounting for variations, then from FIG. 18, it can be seen that the target value can be achieved if the toner particle size is 5.5 (μm) or above, and large-particle silica is added.

In order to improve image quality, it is necessary to reduce the particle size of the magnetic carrier, as well as reducing the particle size of the toner.

However, if the particle size of the carrier is reduced, then the magnetic charge per carrier particle, and the magnetic force applied to each particle, become smaller, and adherence of the carrier to the photosensitive body is greatly worsened. In particular, if the weight-average particle size of the carrier is smaller than 20 (μm), then the fluidity of the developer deteriorates, the stress on the developer increases, and it becomes extremely difficult to avoid decline over time in the drawn amount of developer (which is proportional to deterioration of fluidity), as well as the adherence of carrier particles. Consequently, the following evaluation was carried out with respect to carrier sizes of 20 (μm) or above.

Firstly, the relationship between the two types of carrier adherence and the various settings (carrier resistance, electric field setting, magnetic force intensity) will be described.

The first type of carrier adherence is carrier adherence caused by a counter-charge of opposite polarity to the developed toner remaining on the carrier when the toner is developed in the edge portions of an image, whereby the carrier is developed on the bare surface part of the non-image section (hereafter, this is called "adherence of carrier to the edge portions"). The second type of carrier adherence is caused by carrier adhering to solid portions of the image due to an electric field induced electrostatically in the carrier when the solid portions of the image have a broad developing potential (hereinafter, this is called "adherence of carrier to the solid portions"). This happens because a strong electric field is applied to the carrier particles when the developing potential has a broad range, and the carrier particles are induced with a charge by this electric field and in this charged state, they adhere electrically to the solid portion of the image, due to the electric field.

It is possible to restrict adherence of carrier to the edge portions by removing the counter-charge on the carrier particles, reducing the emphasis of the electric field in the edge portions of the image, and so on. With regard to the emphasis of the electric field at the edge portions, when there is an opposing electrode, then the lines of electric force are aligned in a parallel fashion, but if there is no opposing electrode, then the lines of electric force have nowhere to go and they encircle the edge portions of the image. Even if there is an opposing electrode, if the material between the electrodes has a low dielectric constant, then the lines of electric force will assume an intermediate state between a state of parallel alignment and a state where they encircle the edge portions, and hence the electric field will be emphasized in the edge portions.

In order to prevent a rise in the counter-charge on the carrier particles, it is possible to reduce the resistance of the carrier so that the charge escapes more readily and increase in the counter-charge can be suppressed. Furthermore, by reducing the resistance of the carrier, this method also increases the dielectric constant of the carrier, and therefore makes it possible to reduce the emphasis of electric field at the edge portions. Moreover, by restricting the potential on the surface, in other words, by reducing the electric field in the bare surface sections, the development of carrier particles of increased charge is suppressed, the emphasis at the edges is reduced, and hence adherence of carrier to the edge portions can be suppressed.

On the other hand, in respect of adherence of carrier to the image sections, the lower the resistance, the closer the material comes to being a conductor, and by increasing the resistance of the carrier, it is possible to reduce the electrostatically induced increase in charge, and hence adherence of carrier to the image section can be restricted. Furthermore, if the developing potential is narrowed, then the electrostatic induction is also restricted, the development of carrier particles of increased charge is reduced, and the adherence of carrier to the image section can be suppressed.

As described above, the direction of adjustment of the carrier resistance depends on the positions where the carrier particles are attached in the image, and it must be set very carefully. Furthermore, adherence of the carrier can also be prevented by setting the developing potential and the surface potential appropriately, in other words, by adjusting the electric field setting. However, these characteristics also have a significant effect on image density, surface soiling, and the like, and hence there are cases where it is not possible to decide these characteristics with the sole objective of suppressing carrier adherence.

Therefore, one method of reducing carrier adherence, apart from adjusting the resistance of the electric field of the carrier, is to increase the magnetic force.

Ways of increasing the magnetic force on the main body of the apparatus include raising the magnetic force of the magnetic roller inside the developing sleeve, increasing the width at half maximum of the poles, and so on. However, these methods have secondary effects, such as increased size and cost of the developing sleeve, or hardening of the carrier core and degradation of image quality in fine lines or solid image regions, due to the increase in the magnetic force. Consequently, there are many restrictions on the measures which can be adopted in a product, where mass-production conditions, cost and marketability are essential concerns.

In respect of the aforementioned problems, in the present color printer PR, a magnetic carrier having a measured saturation magnetization value of 70 to 100 (emu/g) is used. The reason for selecting the saturation magnetization of the small-particle carrier as a control condition for resolving the problem of carrier adherence is described below.

In the foregoing description of carrier adherence, the direction of adjustment of the carrier resistance differs according to the position at which adherence of carrier occurs on the image, namely, the image section or the non-image section (or in other words, the surface section), and therefore it is difficult to prevent adherence of carrier by adjusting the resistance.

On the other hand, during the course of our investigations, it was discovered that the saturation magnetization value of the carrier has a uniform correlation with the adherence of carrier, regardless of the position on the image. In other words, a correlation was discovered whereby, when the saturation magnetization value increases, the adherence of carrier decreases, both in the image section and in the surface section.

The lower limit value of the saturation magnetization of the magnetic carrier set in order to restrict carrier adherence will now be described.

FIG. 19 shows the relationship between the particle size of the carrier core material, the saturation magnetization value, and the adherence of carrier to the surface section. As a judgment criteria, it is considered that a number of adhering carrier particles of 100 or fewer (per 100 $cm^2$) is a level which does not present a problem in actual use and does not cause image deterioration. If the average particle size of the carrier is 55 (μm) (the square-shaped plots), then at a saturation magnetization value of the carrier core of 50 (emu/g), the number of adhering carrier particles is 50 (per 100 $cm^2$) which is a level that does not present a problem in actual use.

On the other hand, if the carrier has a size of 35 (μm) (small-particle carrier), then the number of adhering carrier particles is several hundred or more (per 100 $cm^2$) (in fact, an uncountable number), which is completely unsuitable for use. However, if the saturation magnetization of the core material is set to 70 (emu/g), while using a carrier of 35 μm, then the number of adhering carrier particles is 50 (per 100 $cm^2$), which is a level fit for actual use.

Next, the upper limit of the saturation magnetization value of the small-particle carrier, as determined from the path of the magnetic brush, will be described.

FIG. 19 only shows data up to 80 (emu/g), but this is because the value depends on the material of the carrier to be evaluated (in this case, ferrite). The saturation magnetization value depends greatly on the material used, and from separate experimentation, it is known that an adhering carrier figure of 100 or less (per 100 $cm^2$) can be satisfied using magnetite, which has a saturation magnetization value of 91 to 100 (emu/g). There are also ferrous carriers which exceed 100

(emu/g). From the viewpoint of carrier adherence, this presents no problems, but the strong magnetic force means that the core of the magnetic brush becomes relatively rigid, and non-uniformity caused by the trace of the rubbing action of the brush occurs during developing. Consequently, this material is not suitable for use in a color machine where high quality is required. Therefore, in order to prevent non-uniformities caused by the rubbing trace of the brush during developing, desirably, the saturation magnetization of the magnetic carrier is 100 (emu/g) or lower.

To this point, the particle sizes of the toner and carrier, the added amounts of the large-particle silica and small-particle silica, and the added amount of titanium oxide have been investigated respectively and independently. Next, the state within the respective ranges of these figures which would be most liable to give rise to a problem such as surface soiling was taken as Example 1 (namely, toner particle size: 5.5 (μm); carrier particle size: 20 (μm); added amount of large-particle silica: 0.2 (wt %); added amount of small-particle silica: 1.0 (wt %); added amount of titanium oxide: 0.7 (wt %)), and it was investigated whether or not a problem arose. Furthermore, as Comparative Examples 1 to 6, the ranges of the respective figures were varied to include values which would be more liable to produce a problem than those in Practical Example 1, and in each case, it was investigated whether or not a problem arose. The results of this investigation are shown in FIG. 20.

FIG. 20 shows that in Example 1, no problem of surface soiling or the like occurs, whereas a problem of some kind occurs in each of the Comparative Examples 1 to 6. From this, it can be seen that the values in Example 1 are the minimum values for these respective figures and if the figures are equal to or greater than the values in Example 1, then problems caused by reduction in the particle size of the toner and the carrier will not occur.

Above, according to the present embodiment, if the average particle size of the toner is taken to be 5.5 to 8.0 μm, the average particle size by volume of the magnetic carrier is taken to be 20 to 40 (μm), the gap Gp between the photosensitive body and the developing roller is taken to be 0.3 to 0.6 (mm), and the tolerance in Gp is taken to be within ±0.125 (mm), then it is possible to form images of high quality having rank 2.5 in the aforementioned granularity ranking. Furthermore, by adding 0.2 to 0.7 (wt %) of hydrophobic silica of particle size 100 (nm) or above and 1.0 to 2.0 (wt %) of hydrophobic silica of particle size 20 (nm) or below, to the toner, it is possible to maintain toner fluidity over time. Moreover, by adding 0.7 to 1.0 (wt %) of titanium oxide to the toner, it is possible to stabilize the amount of charge on the toner, even in a low-humidity environment. By this means, while achieving high image quality by using toner and carrier of small particle size, deterioration of toner fluidity over time is prevented, and furthermore, the toner charge is maintained at a stable level, even in low-humidity conditions. Therefore, it is possible to achieve stable, high-quality image formation.

Furthermore, by setting the average particle size (by volume) of the toner to 5.5 through 7.0 (μm), the particle size (by volume) of the magnetic carrier, to 20 through 40 (μm), the gap between the photosensitive body and the developing sleeve, Gp, to 0.3 through 0.5 (mm), and the tolerance, to within ±0.125 (mm), a granularity rank of 4 is achieved, and image formation of even higher quality becomes possible.

Moreover, by setting the average particle size (by volume) of the toner to 5.5 through 8.0 (μm), the particle size (by volume) of the magnetic carrier, to 20 through 35 (μm), the gap between the photosensitive body and the developing sleeve, Gp, to 0.3 through 0.5 (mm), and the tolerance, to within ±0.125 (mm), a granularity rank of 4 is achieved, and image formation of even higher quality becomes possible.

Furthermore, by setting the average particle size (by volume) of the toner to 5.5 through 6.0 (μm), the particle size (by volume) of the magnetic carrier, to 20 through 40 (μm), the gap between the photosensitive body and the developing sleeve, Gp, to 0.3 through 0.6 (mm), and the tolerance, to within ±0.125 (mm), a granularity rank of 4.5 is achieved, and image formation of even higher quality becomes possible.

Moreover, by setting the average particle size (by volume) of the toner to 5.5 through 8.0 (μm), the particle size (by volume) of the magnetic carrier, to 20 through 40 (μm), the gap between the photosensitive body and the developing sleeve, Gp, to 0.3 through 0.4 (mm), and the tolerance, to within ±0.125 (mm), a granularity rank of 4 is achieved, and image formation of even higher quality becomes possible.

Furthermore, by using a polymerized toner manufactured by a polymerization process, it is possible to achieve higher image quality than when using a crushed toner. In addition, if a polymerized toner of small-particle silica is used, then deterioration in toner fluidity is liable to arise and surface soiling is liable to occur, but by adding appropriate amounts of hydrophobic silica having a particle size of 100 (nm) or above and hydrophobic silica having a particle size of 20 (nm) or below, to the toner, it is possible to maintain toner fluidity over timer. Furthermore, by adding an appropriate amount of titanium oxide to the toner, it is possible to stabilize the amount of charge on the toner, even in a low-humidity environment.

For the magnetic carrier of small particle size, a carrier having a saturation magnetization value of 70 to 100 (emu/g) according to magnetization measurement is used. Since the saturation magnetization value of the magnetic carrier is 70 (emu/g) or above, then it is possible to suppress the occurrence of carrier adherence, even when using small-particle carrier. Furthermore, since the saturation magnetization value is 100 (emu/g) or below, then it is possible to prevent the occurrence of tracing by the magnetic brush.

According to the first embodiment of the present invention described above, excellent beneficial effects are obtained in that, while achieving high image quality by using toner and carrier of small particle size, deterioration of toner fluidity over time is prevented, and furthermore, the toner charge is maintained at a stable level, even in low-humidity conditions, whereby it is possible to achieve stable, high-quality image formation.

Second Embodiment

The second embodiment serves principally to achieve the second object of the present invention as stated above.

Firstly, the composition and operation of an image forming apparatus according to the second embodiment will be described with reference to FIG. 21 to FIG. 23.

Figure 21:
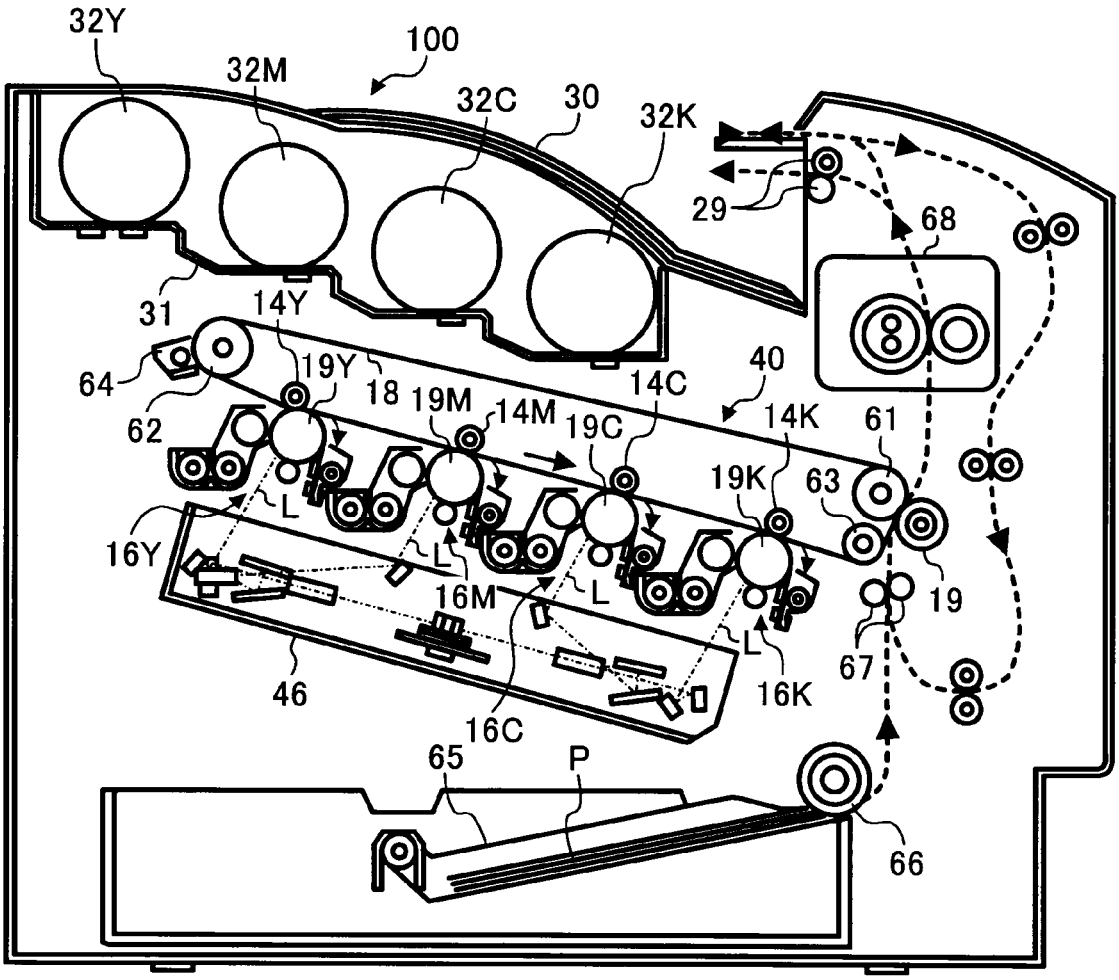
FIG. 21 is a cross-sectional diagram showing a general view of an image forming apparatus according to a second embodiment of the present invention.
Figure 22:
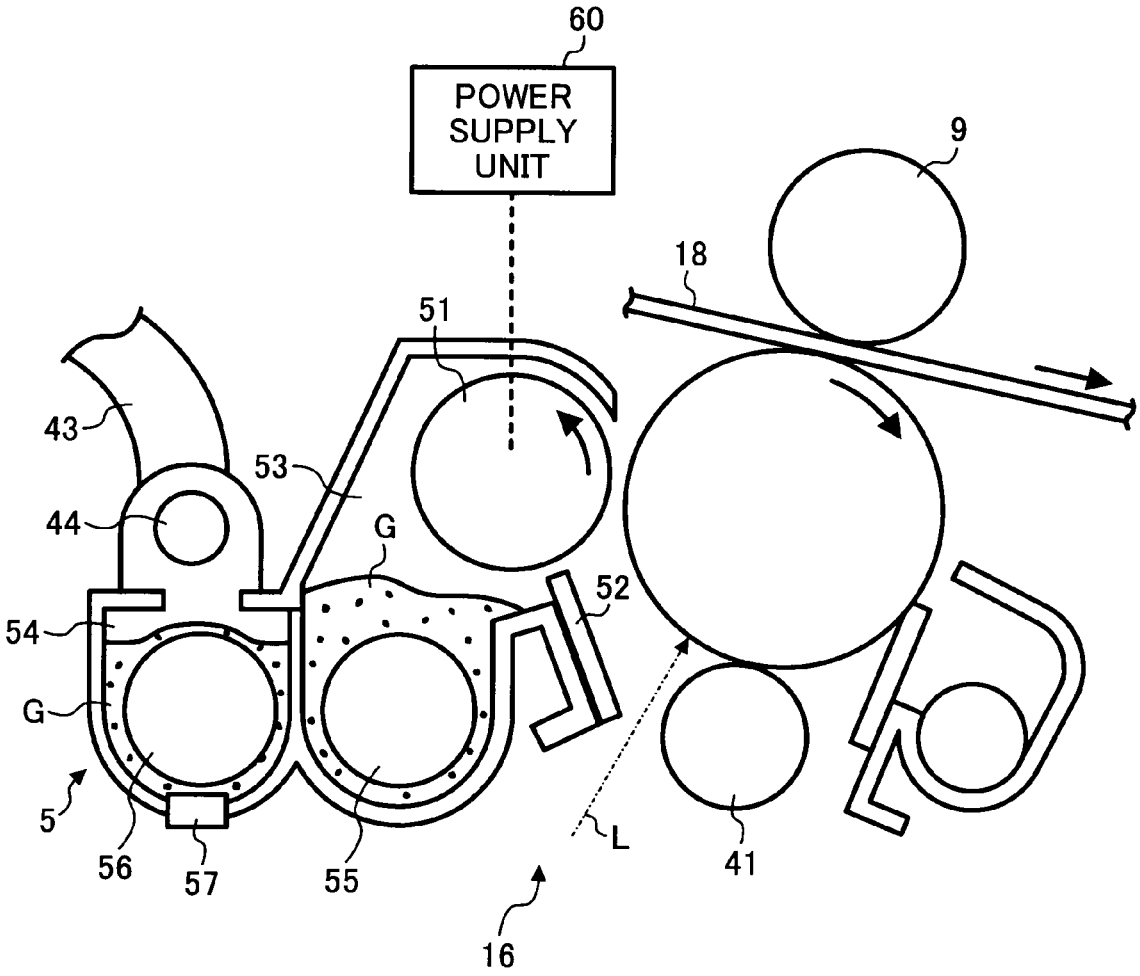
FIG. 22 is a cross-sectional diagram showing the composition of the periphery of an image forming unit in this image forming apparatus.

FIG. 21 is a compositional diagram showing a laser printer, which is an image forming apparatus, and FIG. 22 is an enlarged view showing an image forming unit of same. Moreover, FIG. 23 is a general diagram showing the magnetic poles formed on a developing sleeve 51.

As shown in FIG. 21, process cartridges 16Y, 16M, 16C and 16K, which are image forming units corresponding to the respective colors (yellow, magenta, cyan and black), are arranged in parallel so as to oppose an intermediate transfer belt 18 of an intermediate transfer unit 40. The four process cartridges 16Y, 16M, 16C and 16K disposed in the apparatus main body 100 have virtually the same structure as each other, apart from the different colors of the toners used in the respective image forming processes, and therefore, in FIG. 22, the identifying letter (Y, M, C or K) is omitted from the reference numerals of the process cartridge 16, the photosensitive body 19, and the primary transfer bias roller 14.

Referring to FIG. 22, the process cartridge 16 is formed by integrally composing a photosensitive drum 19 which forms an image carrier, and a charging unit 41, a developing unit 42, and a cleaning unit 45, disposed about the circumferential periphery of the photosensitive drum 19. The process cartridge 16 is composed detachably with respect to the main body 100 of the apparatus. An image forming process (charging step, exposure step, developing step, transfer step, cleaning step, charge removal step) is carried out on the photosensitive drum 19, and a desired toner image is formed on the photosensitive drum 19.

In the present embodiment, the process cartridge 16 is constituted by integrally forming a photosensitive drum 19, a charging unit 41, a developing unit 42 and a cleaning unit 45, but it is also possible to compose these respective sections as independent units which can be installed in and detached from the main body 100 of the apparatus, respectively.

Referring to FIG. 22, the photosensitive drum 19 is driven to rotate in a clockwise direction in FIG. 11, by a drive unit (not illustrated). The surface of the photosensitive drum 19 is charged uniformly at the position of the charging unit 41. (Charging step)

Thereupon, the surface of the photosensitive drum 19 reaches the position of irradiation of the laser light L emitted from the exposure unit 46 (see FIG. 21), and an electrostatic latent image is formed by a scanning exposure at this position. (Exposure step)

Subsequently, the surface of the photosensitive drum 19 reaches a position opposing the developing unit 42, and at this position, the electrostatic latent image is developed and a desired toner image is formed. (Developing step)

More specifically, a two-component developer G comprising a toner and carrier (magnetic carrier) is accommodated inside the developing unit 42. The developer G inside the developing unit 42 is adjusted in such a manner that the ratio of toner in the developer G (the toner concentration), as detected by a toner concentration sensor 57, comes within a prescribed range. In other words, toner is supplied to a developer accommodating unit 54 from a toner conveyance pipe 43 and via a toner supply aperture 44, in accordance with the consumption of toner in the developing unit 42.

In the present embodiment, the toner concentration is controlled to within a range of 4 to 14 wt %.

As shown in FIG. 21, the toner conveyance pipe 43 is connected to a corresponding toner bottle, of the toner bottles 32Y, 32M, 32C and 32K disposed in a bottle holder 31 on the upper part of the main body 100 of the apparatus. Thereby, toners of the various colors are conveyed respectively to the respective developing units 42, from the toner bottles 32Y, 32M, 32C and 32K holding the toners of different colors, via toner conveyance pipes 43.

Thereupon, the toner supplied to the developer accommodating unit 54 is mixed and churned with the developer G, by means of a second conveyance screw 56 and a first conveyance screw 55, while being circulated between two developer accommodating units 53 and 54 (corresponding to a movement in the direction perpendicular to the plane of the drawing in FIG. 22). The toner inside the developer G is attracted to the carrier by acquiring a charge through friction with the carrier, and due to the plurality of magnetic poles formed on the developing sleeve 51, it is held on the developing sleeve 51 together with the carrier. Here, the plurality of magnetic poles formed on the developing sleeve 51 are formed by magnets (not illustrated) disposed inside the developing sleeve 51.

The developer G held on the developing sleeve 51 is conveyed in the direction of the arrow in FIG. 22 and reaches the position of the doctor blade 52. The developer G on the developing sleeve 51 is restricted to a suitable quantity at this position, whereupon it is conveyed to a position opposing the photosensitive drum 19 (which corresponds to the developing region). Thereupon, the toner is attracted onto the latent image formed on the photosensitive drum 19, due to an electric field formed in the developing region.

After the developing step described above, the surface of the photosensitive drum 19 reaches a position opposing the intermediate transfer belt 18 and the first transfer bias roller 14, and at this position, the toner image on the photosensitive drum 19 is transferred onto the intermediate transfer belt 18 (first transfer step). In this case, a small amount of toner that has not been transferred remains on the photosensitive drum 19.

Subsequently, the surface of the photosensitive drum 19 reaches a position opposing the cleaning unit 45, and the untransferred toner remaining on the photosensitive drum 19 is recovered at this position by a cleaning blade 45*a*. (Cleaning step)

Finally, the surface of the photosensitive drum 19 reaches a position opposing a charge removal unit (not illustrated), and at this position, the residual electric potential on the photosensitive drum 19 is removed.

In this way, one sequence of an image forming process carried out on the photosensitive drum 19 is completed.

The image forming process described above is carried out respectively at each of the four process cartridges 16Y, 16M, 16C and 16K. In other words, with reference to FIG. 21, laser light L based on the image information is irradiated from the exposure unit 46 disposed below the process cartridges, toward the photosensitive drums of the respective process cartridges 16Y, 16M, 16C and 16K. More specifically, the exposure unit 46 emits laser light L from a light source and irradiates that laser light L onto the photosensitive drums via a plurality of optical elements, while scanning the laser light L by means of polygonal mirror which is driven so as to rotate. Thereupon, the toner images of respective colors formed on the respective photosensitive drums in the developing steps are then transferred in a mutually superimposed fashion onto the intermediate transfer belt 18. In this way, a color image is formed on the intermediate transfer belt 18.

Here, referring to FIG. 21, the intermediate transfer unit 40 comprises an intermediate transfer belt 18, four primary transfer bias rollers 14Y, 14M, 14C and 14K, a second transfer back-up roller 61, an opposing roller 62, a tension roller 63, a cleaning unit 64, and the like. The intermediate transfer belt 47 is spanned between and supported by the three roller members 61 to 63, and furthermore, it moves endlessly in the direction of the arrow in FIG. 21, due to the rotational drive imparted by one of the roller members 61.

The four primary transfer bias rollers 14Y, 14M, 14C and 14K respectively sandwich the intermediate transfer belt 18 against the photosensitive drums 19Y, 19M, 19C and 19K, thereby forming primary transfer nips. A transfer bias of opposite polarity to the polarity of the toner is applied to the primary transfer bias rollers 14Y, 14M, 14C and 14K.

The intermediate transfer belt 18 travels in the direction of the arrow, and successively passes through the primary transfer nips of the respective primary transfer bias rollers 14K, 14M, 14C and 14K. In this way, the toner images of respective colors on the photosensitive drums 19Y, 19M, 19C and 19K are transferred primarily in a superimposed fashion, onto the intermediate transfer belt 18.

Thereupon, the intermediate transfer belt 18 onto which the mutually superimposed toner images of the respective colors have been transferred reaches a position opposing the secondary transfer roller 19. At this position, the second transfer back-up roller 12 forms a secondary transfer nip by sandwiching the intermediate transfer belt 18 against the second transfer roller 19. The color toner image formed on the intermediate transfer belt 18 is transferred onto a transfer material P, such as transfer paper, which is conveyed to the position of the secondary transfer nip. In this case, untransferred toner which has not been transferred onto the transfer material P remains on the intermediate transfer belt 18.

Thereupon, the intermediate transfer belt 18 reaches the position of the cleaning unit 64 for the intermediate transfer belt 18. At this position, the untransferred toner on the intermediate transfer belt 18 is recovered.

In this way, one sequence of a transfer process carried out on the intermediate transfer belt 18 is completed.

Here, the transfer material P conveyed to the secondary transfer nip position is conveyed from a paper supply unit 65 disposed below the apparatus main body 100, via a paper supply roller 66 and a resist roller pair 67.

More specifically, a plurality of sheets of transfer material P, such as transfer paper, are accommodated in a stacked fashion, in the paper supply unit 65. If the paper supply roller 66 is driven to as to rotate in the anti-clockwise direction in FIG. 21, then the uppermost sheet of transfer material P is supplied to in between the rollers of the resist roller pair 67.

The transfer material P conveyed to the resist roller pair 67 is halted temporarily at the position of the roller nip when the resist roller pair 67 halt rotation. Thereupon, the resist roller pair 67 are driven in rotation in synchronism with the color image on the intermediate transfer belt 18, and the transfer material P is conveyed to the secondary transfer nip. In this way, the desired color image is transferred onto the transfer material P.

Subsequently, the transfer material P onto which the color image has been transferred at the position of the secondary transfer nip is conveyed to the position of the fixing unit 68. At this position, the color image transferred onto the surface of the transfer material P is fixed onto the transfer material P by mans of heat and pressure applied by a fixing roller and a pressure roller.

Thereupon, the transfer material P passes between the rollers of the paper output roller pair 29, and is output to the exterior of the apparatus. The transfer material P output to the exterior of the main body of the apparatus 100 by the paper output roller pair 29 is stacked successively on a stacking unit 30, as an output image.

In this way, one sequence of an image forming process is completed in the image forming apparatus.

Figure 23:
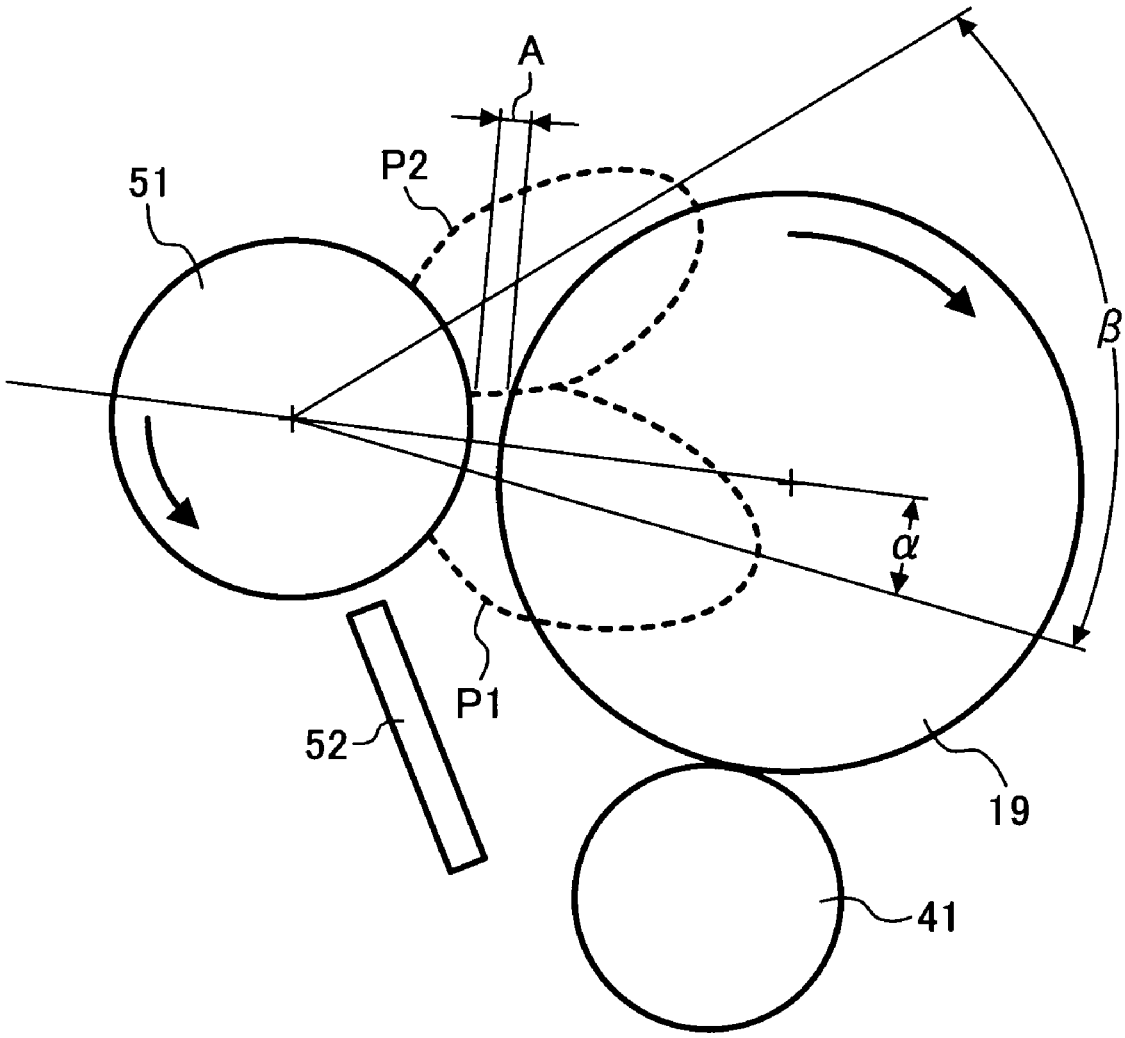
FIG. 23 is a diagram showing the magnetic poles formed on the developing sleeve of the image forming unit.

Here, referring to FIG. 23, the photosensitive drum 19 comprises a base tube of aluminum, constituting a base layer, on top of which a CGL layer (charging generating layer) and a CTL layer (charge transporting layer), and the like, are formed. The outer diameter of the photosensitive drum 19 is 20 to 70 mm, and the CTL layer is formed so as to have a film thickness within a range of 20 to 40 μm. Here, it is possible to use a CTL layer which has an outermost layer formed on top of the CTL layer. More specifically, as the outermost layer, it is possible to use a layer formed by dispersing a conductive filler, which moves electrical charge, in a binder, or it is also possible to use a layer formed by dispersing or mixing an inorganic filler and a charge transporting material (CTM) which moves electrical charge, in a binder.

Furthermore, the developing sleeve 51 is formed in such a manner that its external diameter comes within the range of 10 to 30 mm.

These conditions for the external diameters of the photosensitive drums 19 and the developing sleeves 51 are requirements for achieving size reduction of the image forming apparatus, while satisfying the object of improved quality in the output image and reducing the occurrence of secondary effects, such as image abnormalities, toner scattering, or the like.

Furthermore, referring to FIG. 22, a DC developing bias is applied to the developing sleeve 51 from the power supply unit 60. In other words, only a DC developing bias is applied to the developing sleeve 51, and no AC developing bias is applied to same. Therefore, it is possible to simplify the composition and control sequence of the power supply unit 60 and to reduce device costs, while also reducing the risk of blurred images due to carrier particles having low resistance.

Furthermore, the developing potential formed by the developing bias and the electric potential of the electrostatic latent image formed on the photosensitive drum 19 is set so as to come within the range of 300 to 700 V at the position of maximum image density (maximum image density point). This is one of the conditions for achieving size reduction of the image forming apparatus and improved image quality, while reducing the occurrence of adherence of carrier to the edge portions, adherence of carrier to the solid portions, and other image abnormalities, toner scattering, and the like.

Referring to FIG. 23, a main pole P1 is formed at a position on the developing sleeve 51 opposing the photosensitive drum 19. The magnetic flux density of the main pole P1 in the normal direction is designed to come within a range of 80 to 140 mT. Furthermore, the main pole P1 is disposed in such a manner that the main pole angle $\alpha$ with respect to the straight line linking the center of rotation of the developing sleeve 51 and the center of rotation of the photosensitive drum 19 is some 0 to 100 toward the upstream side in the direction of rotation (the side toward the doctor blade 52). Moreover, the width at half maximum of the main pole P1 (the width between the magnetic flux values where the magnetic flux density becomes one half of the maximum value) is designed to be 20 to 500.

Furthermore, a P2 magnetic pole is formed at a position adjacent to the main pole P1, on the downstream side of the main pole P1 in the direction of rotation. The magnetic flux density in the normal direction of the P2 magnetic pole is designed so as to come within a range of 60 to 140 mT. Furthermore the P2 magnetic pole is disposed in such a manner that it has an angle $\beta$ of 40 to 700 with respect to the main pole P1. Moreover, the width at half maximum of the P2 magnetic pole is designed to be 30 to 60°.

The magnetic flux density formed on the developing sleeve 51 can be measured by abutting a measurement probe (Gaussian meter) (ADS Co.) connected to a magnetic force distribution meter "3-D Magnetism Meter" (Excel System Products Co.), against the developing sleeve 51.

Furthermore, in FIG. 23, other magnetic poles apart from the main poles P1 and P2 (such as drawing magnetic poles, conveyance magnetic poles, developer removing magnetic poles, and the like) are omitted.

Moreover, the drawn amount of the two-component developer G drawn onto the developing sleeve 51 and conveyed to a position opposing the photosensitive drum 19 is set to come within 40 to 70 mg/cm$^2$. In other words, the magnetic flux density of the magnetic pole (drawing magnetic pole) which draws the developer G in the developer accommodating unit 53, onto the developing sleeve 51, and the gap between the doctor blade 52 and the developing sleeve 51 (doctor gap), and the like, are set in such a manner that the drawn amount of the developer G is 40 to 70 mg/cm$^2$. The developing sleeve 51 is made of a non-magnetic material, such as aluminum, and grooves are formed on the outer circumference thereof, at a prescribed pitch in the circumferential direction. Furthermore, the doctor blade 52 made be made of a magnetic metal, such as iron or stainless steel, or a non-magnetic material, such as resin, aluminum, or the like, or it may be made by attaching a magnetic material to a portion of a non-magnetic material.

Furthermore, the developing gap A (the gap between the photosensitive drum 19 and the developing sleeve 51 at the position where they are mutually opposing) is set to be within 0.2 to 0.5 mm. In other words, the photosensitive drum 19 and the developing sleeve 51 are located in position in the frame of the process cartridge 16 in such a manner that the developing gap A is 0.2 to 0.5 mm.

Moreover, the ratio between the linear speeds of the photosensitive drum 19 and the developing sleeve 51 at the position where they are opposing is set so as to come within the range of 1.2 to 2.5. In other words, the gear systems which drive the photosensitive drum 19 and the developing sleeve 51 in the process cartridge 16 are set in such a manner that the linear speed ratio of the developing sleeve 51 with respect to the photosensitive drum 19 is 1.2 to 2.5.

Furthermore, the toner in the developer G inside the developing unit 42 and the toner in the toner bottles 32Y, 32M, 32C and 32K are formed so as to have a weight-average particle size in the range of 3.5 to 7.5 μm.

As a device for measuring the weight-average particle size of the toner particles, it is possible to use a "Coulter counter TA-11" (Coulter Co.) or a "Coulter Multisizer II) (Coulter Co.). The measurement method is described below.

Firstly, 0.1 to 5 ml of a surface active agent (desirably, alkylbenzene sulfonate) is added as a dispersant to 100 to 150 ml of aqueous electrolyte. Here, the aqueous electrolyte is prepared as an aqueous NaCl solution of approximately 1% concentration, using Grade 1 sodium chloride, and for example, "ISOTON-11" (Coulter Co.) is used. Moreover, 2 to 20 mg of a measurement sample is added to this aqueous electrolyte. The aqueous electrolyte containing the suspended sample is then subjected to dispersal processing for approximately 1 to 3 minutes, using an ultrasonic dispersing machine. Thereupon, the weight and number of particles of the toner are measured with the aforementioned measurement device, using a 100 μm aperture, and a weight distribution and quantity distribution are calculated. The weight-average particle size (D4) of the toner is derived from the distributions thus calculated.

The measurement is applied to particles having a size equal to or greater than 2.00 μm and less than 40.30 μm, by using 13 measurement channels, namely, at least 2.00 μm and less than 2.52 μm; at least 2.52 μm and less than 3.17 μm; at least 3.17 μm and less than 4.00 μm; at least 4.00 μm and less than 5.04 μm; at least 5.04 μm and less than 6.35 μm; at least 6.35 μm and less than 8.00 μm; at least 8.00 μm and less than 10.08 μm; at least 10.08 μm and less than 12.70 μm; at least 12.70 μm and less than 16.00 μm; at least 16.00 μm and less than 20.20 μm; at least 20.20 μm and less than 25.40 μm; at least 25.40 μm and less than 32.00 μm; and at least 32.00 μm and less than 40.30 μm.

Furthermore, the toner in the present embodiment is manufactured by means of the following steps. Firstly, a compound having an active hydrogen group, a reactive modified polyester resin, a coloring agent, and a release agent, are dissolved or dispersed in an organic solvent, thereby forming a solution or a dispersion. This solution or dispersion is then dispersed in an aqueous medium containing microparticles of resin. This is reacted with at least one cross-linking agent or extending agent to yield a dispersion, from which the organic solvent is removed. Finally, the resin microparticles attached to the surface of the material are washed and are partially or completely detached, thereby forming toner. The toner formed in this way has a small particle size and an approximately spherical shape, and meets the requirements for achieving high image quality while reducing the occurrence of secondary effects, such as image abnormalities, toner scattering, and the like.

The carrier in the developer G in the developing unit 42 is formed so as to have a weight-average particle size of 20 to 60 μm, a static resistance of $10^{10}$ to $10^{16}$ Ω·cm, and a saturation magnetization value of 40 to 90 emu/g.

Here, the static resistance of the carrier (volume-specific resistance) is found by tapping the carrier by introducing it between parallel electrodes provided with a gap of 2 mm, applying a 1000V DC voltage between the electrodes, waiting for 30 seconds and then measuring the resistance with a high-resistance meter. The measured value is then converted into a volume resistivity.

Furthermore, the saturation magnetization of the carrier is measured by the following measurement method, using a "VSM-P7-15" device (Toei Kogyo Co.). More specifically, a sample of approximately 0.15 g is weighed out and filled into a cell (having an internal diameter of 2.4 mm and a height of 8.5 mm), whereupon the saturation magnetization is measured in a magnetic field of 1000 Oersteds (Oe).

Furthermore, the carrier in the present embodiment has a resin coating layer provided on the surface of the core material. The resin coating layer on the carrier contains conductive particles formed by providing, on the surface of base particles, a conductive coating layer comprising a tin dioxide layer and an indium oxide layer containing tin oxide provided on the tin dioxide layer. The conductive particles contained in the resin coating layer are formed so as to have an oil absorption rate of 10 to 300 ml/100 g.

As the base particles for the conductive particles, it is possible to use at least one type of particle, from amongst aluminum oxide, titanium dioxide, zinc oxide, silicon dioxide, barium sulfide, and zirconium oxide. The oil absorption rate of the conductive particles can be measured in accordance with "21. Oil absorption rate" in JIS-K5101 (Pigment testing methods).

The carrier formed in this way has excellent durability and meets the requirements for achieving improved image quality while reducing the occurrence of secondary effects, such as image abnormalities, toner scattering, or the like.

As described above, the image forming apparatus according to the present embodiment achieves reduction in the size of the apparatus, by setting the external diameter of the photosensitive drums 19 to a range of 20 to 70 mm, and the external diameter of the developing sleeve 51, to a range of 10 to 30 mm. Furthermore, by using only a DC bias as the developing bias applied to the developing sleeve 51, it is possible to simplify the composition and control procedure of the power supply unit 60, and hence to reduce device costs, while also being able to reduce the risk of blurred images due to carrier having a low resistance. Furthermore, by optimizing the prescribed conditions (characteristics values) which have finite limits, it is possible to satisfy the object of improving image quality in the output image, while also reducing the occurrence of secondary effects, such as image abnormalities, toner scattering, or the like.

FIG. 24 illustrates the relationship between the prescribed conditions (characteristics values) described above, and the occurrence of secondary effects, such as image abnormalities, toner scattering, and the like.

FIG. 24 shows a compilation of the results of evaluating image quality in the output image, and the like, when respective running tests of a prescribed number of sheets were performed for a plurality of different levels of the respective characteristics values (namely, the 14 characteristics values indicated in the left-hand column in FIG. 24), in the image forming apparatus illustrated in the present embodiment. For example, the results for the three levels of the "developing gap" in FIG. 24 (namely, the levels "<0.2", "0.2 to 0.5" and ">0.5") are results obtained where the other 13 characteristics values are respectively set to a medium level (for instance, in the case of "linear speed ratio", a level of "1.2 to 2.5").

The main evaluation items are adherence of carrier to the solid portions, adherence of carrier to the edge portions, granularity, blanking out at the trailing edge, halo images, surface soiling, and toner scattering. Furthermore, the evaluation results are indicated in three levels: "O" indicates that the permitted level was fully satisfied; "Δ" indicates that there was little margin with respect to the permitted level; and "x" indicates that the permitted level was not satisfied.

Here, "adherence of carrier to the solid portions" means the phenomenon of carrier particles adhering to the solid portions of the toner image due to electrical charge induced electrostatically in the carrier particles.

"Adherence of carrier to the solid portions" means the phenomenon of carrier particles adhering to the edge portions of the toner image, due to the counter-charge of the carrier particles.

"Granularity" means the degree to which toner particles fail to adhere to positions where they ought to adhere, with respect to half-tone images based on a latent image of dots. If the granularity is poor, then a rough-looking image is obtained.

"Blanking out at the trailing edge" is a phenomenon whereby the trailing edge of the tone image is cut off, due to the fact that the linear speed ratio of the developing sleeve with respect to the photosensitive drum is greater than 1. In other words, if the carrier held on the developing sleeve includes carrier which does not have toner adhering sufficiently to the surface thereof and this carrier passes over the non-image section and reaches the image section due to the linear speed ratio, then the developed toner adhering to the image section will become attached to the carrier (on the developing sleeve).

A "halo image" is a phenomenon which occurs when forming an image which appears to have a solid region, in a half-tone image. Due to edge effects, the latent half-tone image surrounding the solid region is emphasized, and a portion thereof is blanked out, in addition to which carrier held on the developing sleeve which does not have toner adhering sufficiently to itself passes over the non-image section and reaches the image section, due to the linear speed ratio, whereby the developed toner at the leading edge of the solid region becomes attached to the carrier (on the developing sleeve).

"Surface soiling" means the phenomenon of toner adhering to the surface sections (non-image sections) where toner is not supposed to adhere.

"Toner scattering" means the phenomenon of toner scattering from the developing unit 42. The toner accommodated inside the developing unit 42 is scattered due to the balance of the suction air flow occurring in the periphery of the developing sleeve 51, and the toner is also scattered due to the centrifugal force caused by the rotation of the developing sleeve 51.

From the experimental results shown in FIG. 24, it can be seen that the levels of adherence of carrier to the solid portions and blanking out at the trailing edge become worse when the developing gap is less 0.2 mm. This is because the electric field is strengthened when the developing gap is narrow.

Furthermore, if the developing gap is greater than 0.5 mm, then the levels relating to granularity, halo image, surface soiling and toner scattering become worse. The deterioration in granularity is due to the fact that the toner particles become less certain to adhere to the positions where they are supposed to adhere, the greater the developing gap and the smaller the developing capacity. The deterioration in the halo images is due to the fact that edge effects are emphasized, if the developing gap is large. Toner scattering deteriorates because a large air flow is generated about the developing sleeve, if there is a large developing gap. Furthermore, there is a slight deterioration in surface soiling because the control of the toner concentration shifts towards higher values if there is a large developing gap.

Due to these points, the optimal value for the developing gap is in the range of 0.2 to 0.5 mm.

If the linear speed ratio is less than 1.2, then the levels of the granularity and surface soiling become worse. The granularity deteriorates because, the smaller the linear speed ratio, the lower the probability that the toner particles will make contact with the positions where they are meant to adhere. The deterioration in surface soiling is due to the fact, the smaller the linear speed ratio, the lower the electrical scraping force acting on the toner particles adhering to the surface sections.

Furthermore, if the linear speed ratio is greater than 2.5, then the levels of adherence of carrier to the solid portions, adherence of carrier to the edge portions, blanking out at the trailing edge, halo images, and toner scattering, all become worse. The deterioration in the adherence of carrier to the solid portions, adherence of carrier to the edge portions, and toner scattering is due to the increase in the centrifugal force acting on the toner on the developing sleeve which results when the linear speed ratio increases. The deterioration in blanking out at the trailing edge and halo images is a result of the fact that the surface area over which toner adhering to the image section is scraped up becomes larger, when the linear speed ratio increases.

Due to these points, the optimal value for the linear speed ratio of the developing sleeve with respect to the photosensitive drum is in the range of 1.2 to 2.5.

If the magnetic force of the main pole (namely, the magnetic flux density at the main pole P1 in the normal direction with respect to the magnetic force) is less than 80 mT, then the levels of adherence of carrier to the solid portions and adherence of carrier to the edge portions become worse. This is because, when the magnetic force of the main pole is small, the force holding the carrier particles onto the developing sleeve becomes weaker.

Furthermore, taking account of the effects on other magnetic poles, cost considerations, and the like, it is desirable to set an upper limit of 140 mT for the magnetic force of the main pole.

From the aforementioned points, the optimal value of the magnetic flux density, in the normal direction with respect to the magnetic force, of the main pole P1 formed on the developing sleeve is in the range of 80 to 140 mT.

If the angle $\alpha$ of the main pole is less than 0°, then the levels of adherence of carrier to the solid portions, adherence of carrier to the edge portions and surface soiling become worse. Adherence of carrier to the solid portions and adherence of carrier to the edge portions deteriorate because, as the main pole angle becomes smaller and the main pole is positioned further toward the downstream side in the direction of rotation, the carrier particles become more liable to be scattered from the tip of the magnetic brush held on the developing sleeve. The deterioration in surface soiling is due to the fact that, as the main pole angle becomes smaller and the main pole is positioned further toward the downstream side in the direction of rotation, scavenging in the surface sections becomes worse.

If the main pole angle $\alpha$ is greater than 10°, then the level of the granularity becomes slightly worse. This happens because, as the main pole angle becomes larger and the main pole is positioned further toward the upstream side in the direction of rotation, the tip of the magnetic brush moves further away from a position directly opposing the photosensitive drum, and hence the probability of the toner particles making contact with the positions they are supposed to adhere to declines.

Due to these points, the optimal value of the main pole angle $\alpha$ is in the range of 0 to 100. Incidentally, the main pole angle $\alpha$ does not have a significant effect on image quality, and the like, in comparison with other characteristics values.

If the magnetic force of the magnetic pole P2 (namely, the magnetic flux density at the magnetic pole P2 in the normal direction with respect to the magnetic force) is less than 60 mT, then the levels of adherence of carrier to the solid portions and adherence of carrier to the edge portions become worse. This is because, when the magnetic force of the magnetic pole P2 is small, the force holding the carrier particles onto the developing sleeve becomes weak.

Furthermore, taking account of the effects on other magnetic poles, cost considerations, and the like, it is desirable to set an upper limit of 140 mT for the magnetic force of the magnetic pole P2.

From the aforementioned points, the optimal value of the magnetic flux density, in the normal direction with respect to the magnetic force, of the magnetic pole P2 formed on the developing sleeve is in the range of 60 to 140 mT.

If the toner concentration is less than 4 wt %, then the levels of adherence of carrier to the solid portions and granularity become worse. The deterioration in adherence of carrier to the solid portions is caused by the decline in carrier resistance that occurs when the toner concentration is low. The deterioration in granularity is due to the fall in the level of development that occurs when the toner concentration is low.

Furthermore, if the toner concentration is greater than 14 wt %, then the levels of surface soiling and toner scattering become worse. This is because the toner charge (Q/M) falls when the toner concentration is high, and hence the electrostatic force of attraction between the toner particles and carrier particles becomes weaker.

Due to the above points, the optimal control range for the toner concentration is a range of 4 to 14 wt %. Furthermore, desirably, the toner concentration is controlled in such a manner that the toner coverage rate with respect to the surface of the carrier particles is 70% or lower.

If the drawn amount of the developer is less than 40 mg/cm$^2$, then the levels of granularity, surface soiling and toner scattering become worse. The deterioration in granularity is due to the fact that the level of development falls when the drawn amount becomes smaller. The deterioration in surface soiling is caused by the worsening of scavenging that occurs when the drawn amount becomes smaller. Furthermore, the deterioration in toner scattering is caused by the reduced suction air flow that results when the drawn amount becomes smaller.

Moreover, if the drawn amount of the developer is greater than 70 mg/cm$^2$, then the levels of adherence of carrier to the solid portions and halo images become worse. Adherence of carrier to the solid portions deteriorates because, if the drawn amount is increased, the amount of carrier also increases, and there is a greater probability that carrier particles will adhere to the solid portions. The level of halo images deteriorates because, if the drawn amount is increased, the amount of carrier also increases, and the force which scrapes off toner particles adhering to the image section becomes greater.

From the above points, the optimal value of the drawn amount of developer is in the range of 40 to 70 mg/cm$^2$.

If the developing potential is greater than 700V, then the level of adherence of carrier to the solid portions becomes worse. This occurs because increasing the developing potential means that the toner concentration is controlled to a lower level, and hence the resistance of the carrier falls.

Furthermore, desirably, a lower limit of 300V is set for the developing potential, in order to prevent the occurrence of surface soiling as a result of having to control the toner concentration to a high level.

From the above points, the optimal value for the developing potential in the range of 300 to 700 V. Incidentally, the developing potential does not have a significant effect on image quality, and the like, in comparison with other characteristics values.

If the surface potential is less than 50V, then the level of surface soiling becomes worse. This is because the low value of the surface potential means that force retaining the toner particles on the developing sleeve becomes weaker.

If the surface potential is greater than 250V, then the levels of adherence of carrier to the edge portions, blanking out at the trailing edge and halo images become worse. The deterioration in adherence of carrier to the edge portions occurs because, as the surface potential increases, then the force pulling the carrier particles onto the photosensitive drum becomes stronger. Furthermore, the deterioration in blanking out at the trailing edge, and halo images, is due to the fact that, when the surface potential is high, there is increased toner drift, together with a worsening of edge effects.

From the above points, the optimal value of the surface potential is in the range of 50 to 250 V. Incidentally, the surface potential does not have a significant effect on the image quality, and the like, in comparison with other characteristics value.

If the film thickness of the CTL layer of the photosensitive drum is less than 20 μm, then the levels of adherence of carrier to the solid portions and blanking out at the trailing edge become worse. This is because the electric field is emphasized in the developing region, as the film thickness of the CTL layer becomes smaller.

Furthermore, if the film thickness of the CTL layer is greater than 40 μm, then the levels of adherence of carrier to the edge portions and halo images become worse. This is because edge effects are emphasized in the developing region, when the film thickness of the CTL layer becomes large.

From the above points, the optimal value for the film thickness of the CTL layer is in the range of 20 to 40 μm.

If the particle size of the toner (weight-average particle size) is greater than 7.5 μm, then the level of the granularity becomes worse. This is because increasing the toner particle size makes it more difficult for the toner particles to adhere faithfully to the latent image where they are supposed to adhere.

Moreover, taking account of the effects on blanking out at the trailing edge and halo images which occur when the amount of adhering toner in the toner image is small, it is desirable to set a lower limit of 3.5 μm for the toner particle size.

From the above points, the optimal value of the weight-average particle size of the toner is in the range of 3.5 to 7.5 μm.

If the particle size of the carrier (weight-average particle size) is less than 20 μm, then the levels of adherence of carrier to the solid portions and adherence of carrier to the edge portions become worse. This is because the reduction in carrier particle size causes a reduction in the magnetic force acting on each carrier particle.

If the carrier particle size is larger than 60 μm, then the level of the granularity becomes worse. This is because increasing the carrier particle size makes it more difficult for the toner particles to adhere faithfully to the latent image where they are supposed to adhere.

From the above points, the optimal value of the weight-average particle size of the carrier is in the range of 20 to 60 μm.

If the carrier resistance (static resistance) is less than $10^{10}$ Ω·cm, then the levels of adherence of carrier to the solid portions and blanking out at the trailing edge become worse. This happens because, as the carrier resistance becomes smaller, the carrier particles become more liable to electrostatic induction, while at the same time, the electric field is emphasized.

If the carrier resistance is greater than $10^{16}$ Ω·cm, then the levels of adherence of carrier to the edge portions, the granularity, and halo images, become worse. This occurs because, when the carrier resistance becomes large, the developing capacity calls, while at the same time, edge effects are accentuated.

From the above points, the optimal value of the static resistance of the carrier is in the range of $10^{10}$ to $10^{16}$ Ω·cm.

If the saturation magnetization of the carrier is less than 40 emu/g, then the levels of adherence of carrier to the solid portions and adherence of carrier to the edge portions become worse. This is because the force which holds the carrier on the developing sleeve becomes weaker, as the saturation magnetization of the carrier reduces.

Furthermore, desirably, an upper limit of 90 emu/g is set for the saturation magnetization of the carrier, in consideration of the effects on the developer removing magnetic pole (namely, a problem arising at the developer removing magnetic pole whereby the carrier is not removed reliably from the developing sleeve and returned to the developing section after the developing stage).

From the above points, the optimal value of the saturation magnetization of the carrier is in the range of 40 to 90 emu/g.

Although not included in the table shown in FIG. 24, if the width at half-maximum of the main pole P1 is less than 20°, then the levels of adherence of carrier to the solid portions and adherence of carrier to the edge portions become worse. This happens because, if the width at half-maximum of the magnetic pole P1 is small, then the magnetic brush held on the developing sleeve will stand out too far and the carrier particles will readily become detached from the developing sleeve.

Furthermore, desirably, an upper limit of 500 is set for the width at half-maximum of the magnetic pole P1, in consideration of the relationship with the other magnetic poles.

From the above points, the optimal value of the width at half-maximum of the magnetic pole P1 is in the range of 20 to 50°. The width at half-maximum of the magnetic pole P1 does not have a significant effect on image quality, and the like, in comparison with other characteristics values.

Although omitted from the table listed in FIG. 24, if the width at half-maximum of the magnetic pole P2 is less than 30°, then the levels of adherence of carrier to the solid portions and adherence of carrier to the edge portions will become worse. This is because, if the width at half-maximum of the magnetic pole P2 is small, then the force holding the carrier particles onto the developing sleeve as it passes through the developing region, and the range of that force, are reduced.

Furthermore, desirably, an upper limit of 60° is set for the width at half-maximum of the magnetic pole P2, in consideration of the relationship with other magnetic poles.

From the above points, the optimal value of the width at half-maximum of the magnetic pole P2 is in the range of 30 to 60°. Incidentally, the width at half maximum of the magnetic pole P2 does not have a significant effect on image quality, and the like, in comparison with other characteristics values.

Although omitted from the table listed in FIG. 24, if the angle β of the magnetic pole P2 with respect to the main pole P1 is greater than 70°, then the levels of adherence of carrier to the solid portions and adherence of carrier to the edge portions become worse. This happens because, if the angle β is large, then the combined magnetic force of the main pole P1 and the magnetic pole P2 becomes smaller, and the force holding the carrier on the developing sleeve becomes weaker.

Furthermore, desirably, a lower limit of 40° is set for the angle β of the magnetic pole P2 with respect to the main pole P1, in consideration of the relationship with other magnetic poles.

From the above points, the optimal value for the angle β of the magnetic pole P2 with respect to the main pole P1 is in the range of 40 to 70°. The angle β of the magnetic pole P2 with respect to the main pole P1 does not have a significant effect on image quality, and the like, in comparison with other characteristics values.

The respective characteristics values described above may be substituted with other correlated characteristics value.

For example, in the present embodiment, the toner concentration is controlled to a range of 4 to 14 wt %, but since the toner concentration, the toner charge (Q/M), the toner fluidity, and the like, are interrelated, then instead of specifying a range for the toner concentration, as described above, it is also possible to specify a prescribed range for the toner charge (Q/M), toner fluidity, or the like.

As described above, in the second embodiment, the objects of reducing the size of the apparatus and improving image quality are satisfied, and furthermore, prescribed conditions (characteristics values) are selected and optimized in order that the occurrence of both adherence of carrier to the edge portions and adherence of carrier to the solid portions is reduced, while also reducing the occurrence of secondary effects, such as image abnormalities, toner scattering, and the like. Thereby, it is possible to provide a high-quality image forming apparatus and process cartridge, having a high level of reliability.

The present invention is not limited to the present embodiments, and the embodiments may be modified suitably beyond the range suggested in the embodiments, without departing from the technical scope of the present invention. Furthermore, the numbers, positions, shapes, and the like, of the constituent members described above are not limited to those described in the embodiments, and suitable numbers, positions, shapes, and the like, may be adopted in implementing the present invention.

According to the second embodiment of the present invention described above, the objects of reducing the size of the apparatus and improving image quality are satisfied, and at the same time, prescribed conditions are selected and optimized in such a manner that the occurrence of both adherence of carrier to the edge portions and adherence of carrier to the solid portions is reduced, while also reducing the occurrence of secondary effects, such as image abnormalities, toner scattering, and the like. Thereby, it is possible to provide a highly reliable, high-quality image forming apparatus and process cartridge, which achieve size reduction and improved image quality.

Various modifications will become possible for those skilled in the art after receiving the teachings of the present disclosure without departing from the scope thereof.

What is claimed is:

1. An image forming apparatus comprising: a photosensitive drum, having a CTL layer, on which a desired electrostatic latent image is formed; and a developing unit which accommodates a two-component developer comprising a toner and a carrier, provided with a developing sleeve which holds said two-component developer in a position opposing said photosensitive drum;

wherein the external diameter of said photosensitive drum is 20 through 70 mm, and the film thickness of said CTL layer is 20 through 40 μm;

the external diameter of said developing sleeve is 10 through 30 mm;

a DC developing bias only is applied to said developing sleeve;

the drawn amount of the two-component developer which is drawn onto said developing sleeve and arrives at said opposing position is 40 through 70 mg/cm$^2$;

the magnetic flux density in the normal direction of a main pole formed at said opposing position, of a plurality of magnetic poles formed on said developing sleeve, is 80 through 140 mT, and the magnetic flux density in the normal direction of a magnetic pole P2 formed adjacent to said main pole on the downstream side is 60 through 140 mT;

the gap between said photosensitive drum and said developing sleeve at said opposing position is 0.2 through 0.5 mm;

the linear speed ratio of said developing sleeve with respect to said photosensitive drum at said opposing position is 1.2 through 2.5;

the toner concentration of the two-component developer accommodated in said developing unit is controlled so as to be 4 through 14 wt %;

the weight-average particle size of said toner is 3.5 through 7.5 μm; and said carrier has a weight-average particle size of 20 through 60 μm, a static resistance of $10^{10}$ through $10^{16}$ Ω·cm, and a saturation magnetization of 40 through 90 emu/g.

2. The image forming apparatus as claimed in claim 1, wherein said main pole formed on said developing sleeve is formed in such a manner that the angle of the main pole with respect to the straight line linking the center of rotation of said developing sleeve and the center of rotation of said photosensitive drum is 0 through 10° on the upstream side in the direction of rotation, and the width at half-maximum is 20 through 50°.

3. The image forming apparatus as claimed in claim 1, wherein said magnetic pole P2 is formed in such a manner that the angle thereof with respect to said main pole is 40 through 70° on the downstream side in the direction of rotation, and the width at half-maximum is 30 through 60°.

4. The image forming apparatus as claimed in claim 1, wherein a developing potential created by said developing bias and an electric potential of said electrostatic latent image is controlled so as to be in the range of 300 through 700V at the position of maximum image density.

5. The image forming apparatus as claimed in claim 1, wherein said toner is formed by dissolving or dispersing in an organic solvent at least a compound having an active hydrogen group, a reactive modified polyester resin, a coloring agent, and a release agent, dispersing the solution or dispersion thus formed in an aqueous medium containing resin microparticles, reacting the resulting dispersion with a cross-linking agent and/or an extending agent, and then removing the organic solvent from the dispersion thus obtained and washing the resin microparticles adhering to the surface thereof to detach all or a portion of the resin microparticles.

6. The image forming apparatus as claimed in claim 1, wherein said carrier has a resin coating layer formed on the surface of a core material;

said resin coating layer contains conductive particles formed by providing, on the surface of base particles in the resin coating layer, a conductive coating layer comprising a tin dioxide layer and an indium oxide layer containing tin dioxide and provided on said tin dioxide layer; and said conductive particles are formed so as to have an oil absorption rate of 10 through 300 ml/100 g.

* * * * *